US005394867A

United States Patent [19]

Swann

[11] Patent Number: 5,394,867

[45] Date of Patent: * Mar. 7, 1995

[54] PERSONAL DISPOSABLE EMERGENCY BREATHING SYSTEM WITH DUAL AIR SUPPLY

[75] Inventor: Linsey J. Swann, Vancouver, Canada

[73] Assignee: Brookdale International Systems Inc., Vancouver, Canada

[ * ] Notice: The portion of the term of this patent subsequent to Feb. 16, 2010 has been disclaimed.

[21] Appl. No.: 101,233

[22] Filed: Aug. 2, 1993

Related U.S. Application Data

[63] Continuation-in-part of Ser. No. 710,812, Jun. 5, 1991, Pat. No. 5,186,165, and a continuation-in-part of Ser. No. 984,529, Dec. 2, 1992, Pat. No. 5,315,987.

[51] Int. Cl.[6] ..... A62B 18/10; A62B 7/10; A62B 19/00; A62B 23/02

[52] U.S. Cl. ..... 128/201.25; 128/201.28; 128/205.25; 128/206.12; 128/201.26

[58] Field of Search ..... 128/201.19, 201.22–201.26, 128/201.28, 205.27–205.29, 206.11, 206.17, 206.12, 205.25

[56] References Cited

U.S. PATENT DOCUMENTS

| | | |
|---|---|---|
| 1,345,323 | 6/1920 | Frazer et al. . |
| 1,422,211 | 7/1922 | Lamb . |
| 1,606,749 | 11/1926 | Clark et al. . |
| 1,630,209 | 5/1927 | Olgard . |
| 1,889,015 | 11/1932 | Davis . |
| 1,931,989 | 10/1933 | Jenness . |
| 2,376,971 | 5/1945 | Kleit . |
| 3,120,997 | 2/1964 | Petrocelli . |
| 3,277,890 | 10/1966 | Warncke . |
| 3,321,277 | 5/1967 | Bach . |

(List continued on next page.)

FOREIGN PATENT DOCUMENTS

| | | |
|---|---|---|
| 1076041 | 4/1908 | Canada . |
| 775035 | 1/1968 | Canada . |
| 778323 | 2/1968 | Canada . |
| 828671 | 12/1969 | Canada . |
| 1167235 | 3/1986 | Canada . |
| 0124263 | 11/1984 | European Pat. Off. . |
| 0294707 | 12/1988 | European Pat. Off. . |
| 597685 | 5/1934 | Germany . |
| 2115292 | 9/1983 | United Kingdom . |
| 2233905 | 1/1991 | United Kingdom . |
| 2238480 | 6/1991 | United Kingdom . |
| 22404463 | 8/1991 | United Kingdom . |

*Primary Examiner*—Kimberly L. Asher
*Attorney, Agent, or Firm*—Nixon & Vanderhye

[57] ABSTRACT

The breathing system comprises a canister carrying layered filtering material, including activated carbon granules, a dessicant, a catalyst for the catalyzation of carbon monoxide to carbon dioxide, optionally lithium peroxide, for conversion of $CO_2$ to $O_2$, and electrostatically charged filters between the layers of filtering material. A mouthpiece carrying a noseclip, and inhalation and exhalation check valves and a whistle is disposed within a flexible, substantially completely transparent hear-through hood, both the mouthpiece and hood being disposed in the canister between the filtering material and a cover for the canister. An air flow conduit is connected to an external source of air for supplying air to the mouthpiece and bypassing the filtration unit. In use, the canister is deployed from a compartment, the cover is removed and the hood is drawn about an individual's head and substantially sealed about the neck. With the mouthpiece in the individual's mouth, and noseclip closing off the user's nose, ambient air flows through the filtering material and air from the external source flows through the air flow conduit to the user. A quick disconnect coupling is used to disconnect the system from the external air source whereby the individual breathes only filtered ambient air.

19 Claims, 12 Drawing Sheets

U.S. PATENT DOCUMENTS 3,413,089 11/1968 Coussemant et al. .
3,446,588 5/1969 Smith .
3,604,416 9/1971 Petrahai et al. .
3,739,774 6/1973 Gregory .
3,920,803 11/1975 Boryta .
4,187,843 2/1980 Warncke et al. .
4,200,092 4/1980 Warncke et al. .
4,205,673 6/1980 Wise et al. .
4,213,453 7/1980 Warncke et al. .
4,276,877 7/1981 Gdulla .
4,292,967 10/1981 Pasternack .
4,325,364 4/1982 Evans .
4,362,153 12/1982 Wilson et al. .
4,428,372 1/1984 Beysel et al. .
4,459,981 7/1984 Mascher et al. .
4,461,291 7/1984 Mascher et al. .
4,467,795 8/1984 Eckstein .
4,491,130 1/1985 Pasternack .
4,494,538 1/1985 Ansite .
4,572,178 2/1986 Takase et al. .
4,573,464 3/1986 Yo .
4,583,535 4/1986 Saffo .
4,614,186 9/1986 John .
4,677,976 7/1987 Fujinuma et al. .
4,687,640 8/1987 Schillaci .
4,766,893 8/1988 Drews .
4,793,342 12/1988 Haber et al. .
4,805,608 2/1989 Eckstein et al. .
4,817,597 4/1989 Tanaka .
4,883,052 11/1989 Weiss et al. .
4,886,058 12/1989 Brostrom et al. .
4,889,113 12/1989 Pelloux-Gervais et al. .
4,963,327 10/1990 Russell .
4,996,981 3/1991 Elenewski et al. .
5,113,854 5/1992 Dosch et al. .
5,115,804 5/1992 Brookman .
5,186,165 2/1993 Swann .

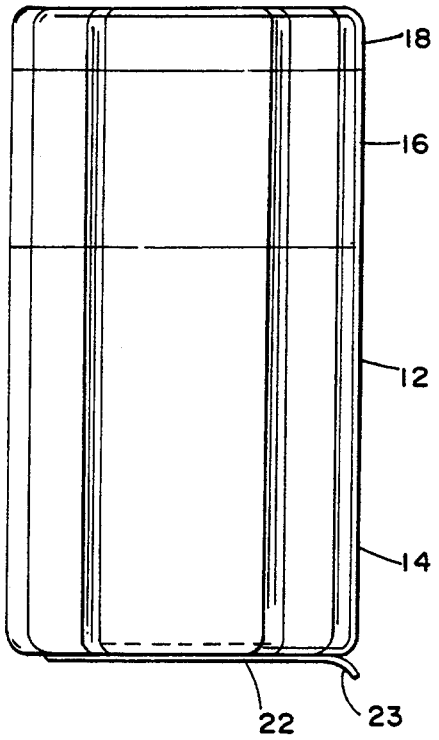
*Fig. 1*
*Fig. 2*
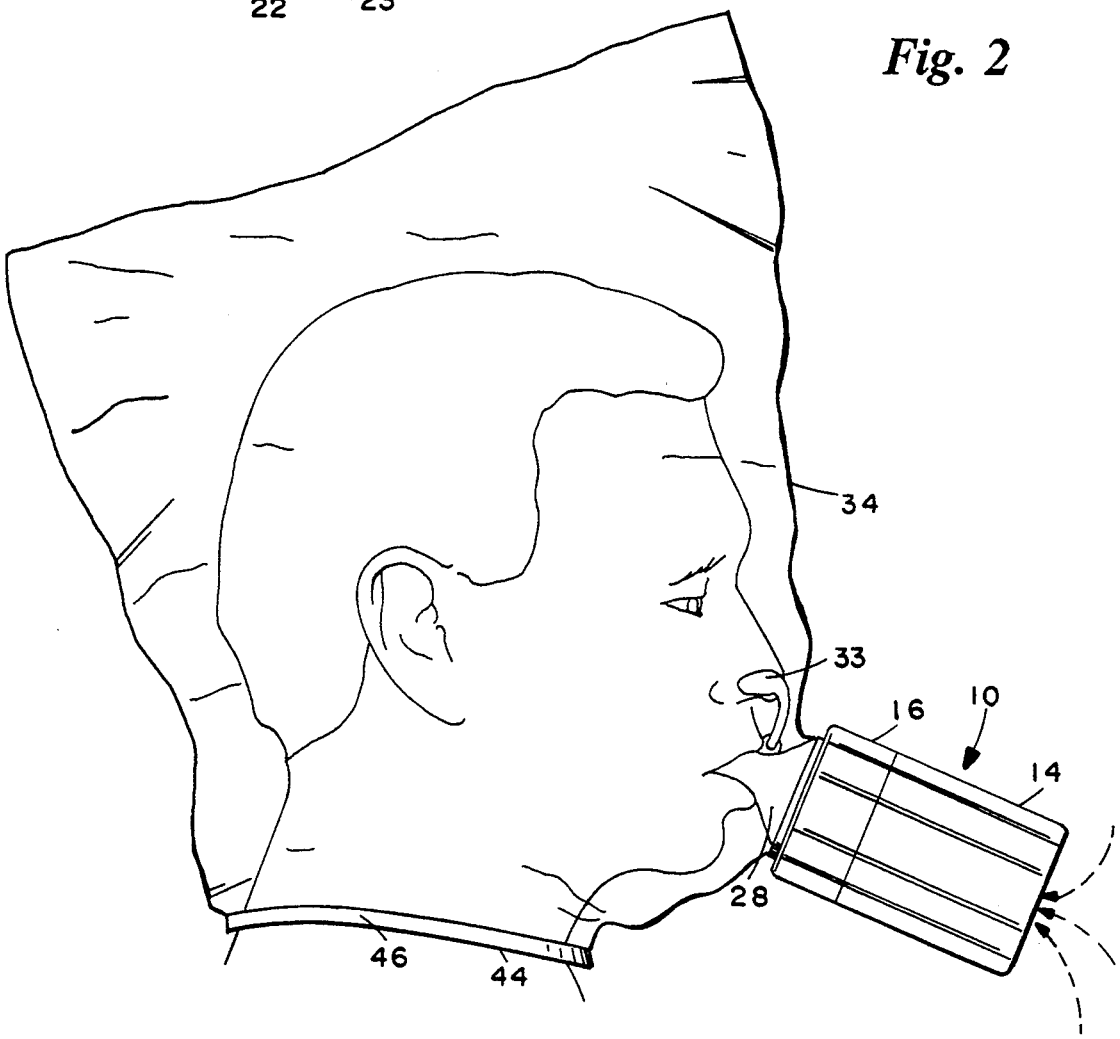

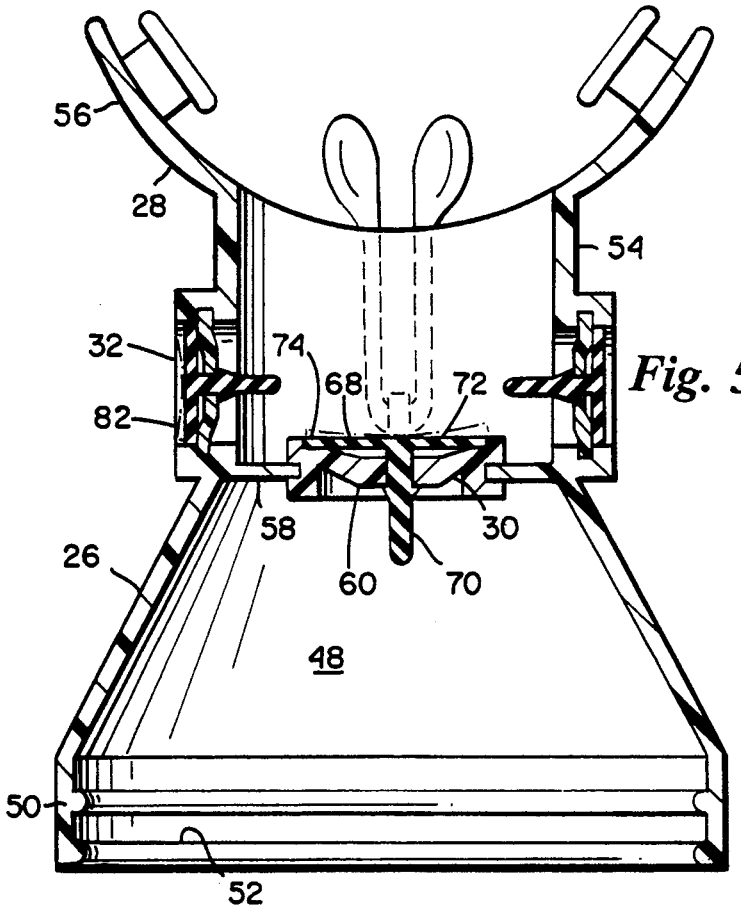
Fig. 5
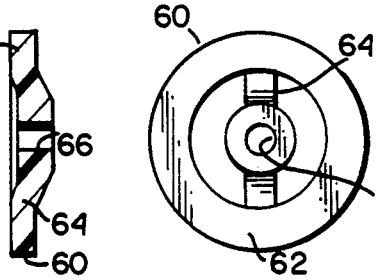
Fig. 6A
Fig. 6B
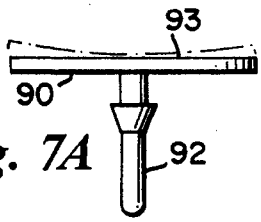
Fig. 7A
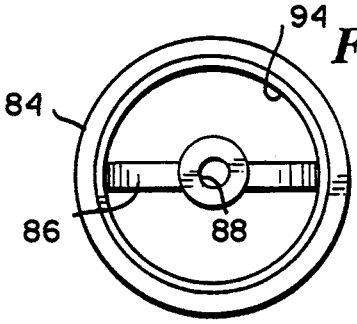
Fig. 8A
Fig. 7B
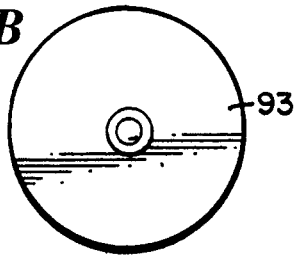
Fig. 8B
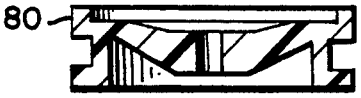

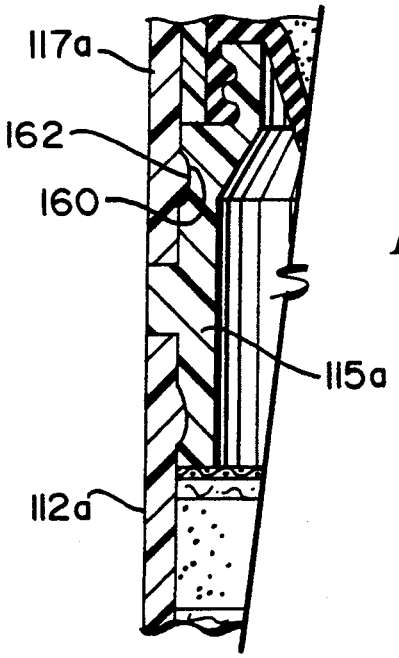
Fig. 13A
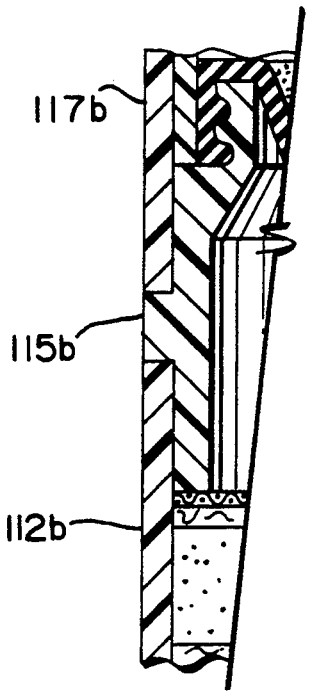
Fig. 13 B
Fig. 14
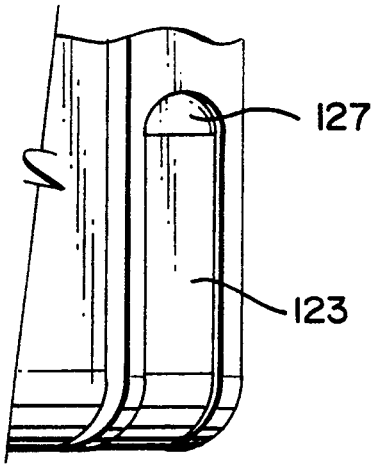

*Fig. 16A*
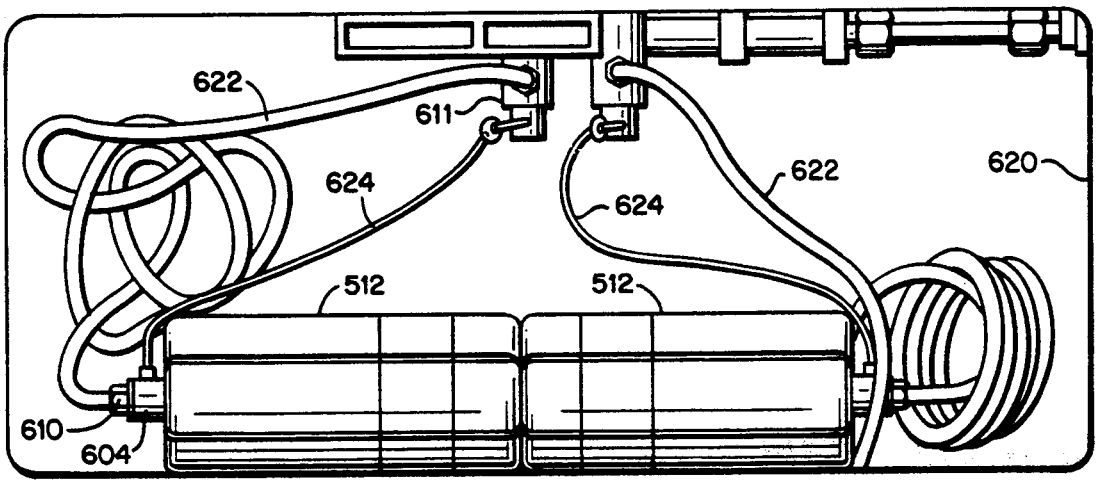
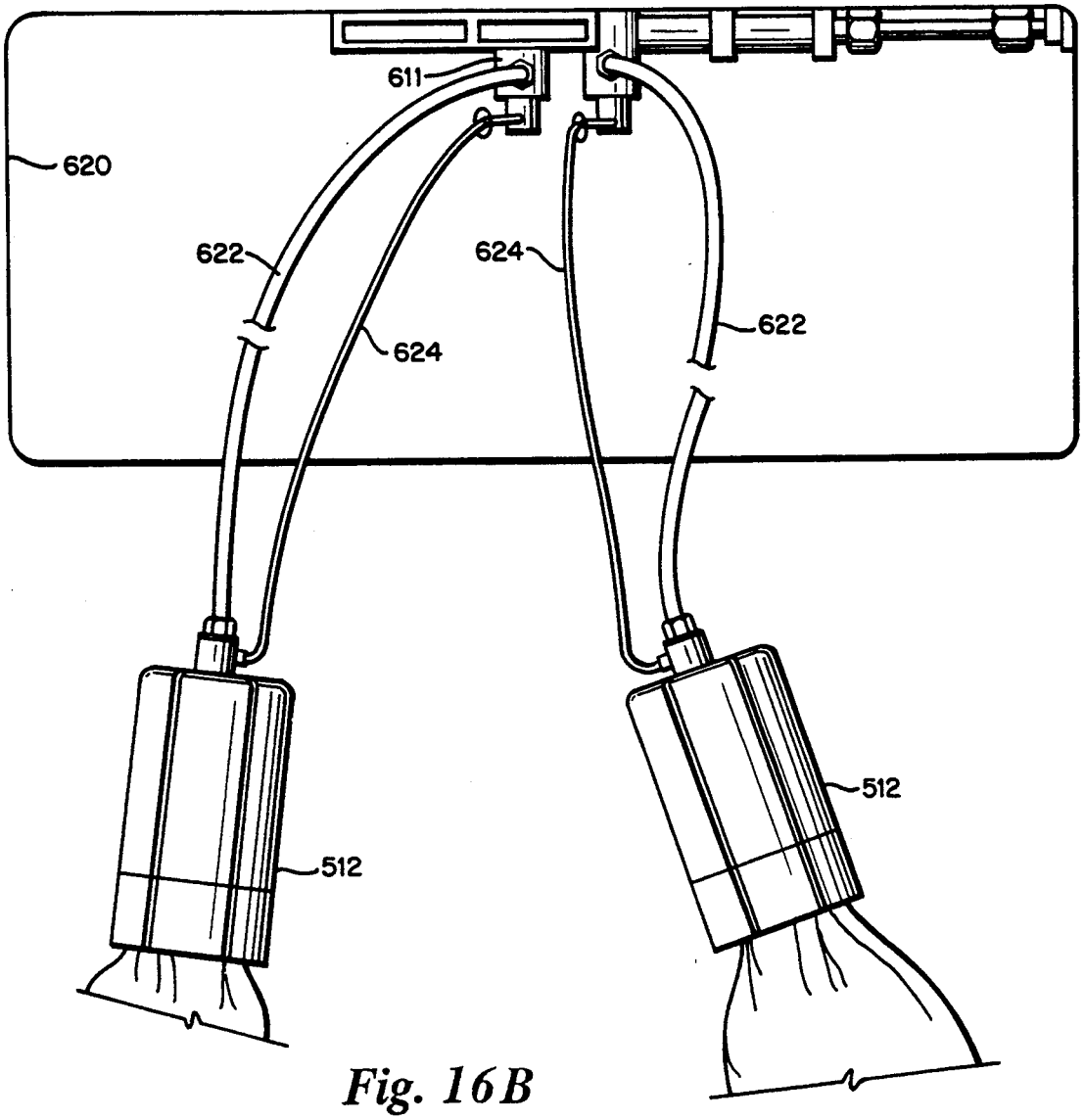
*Fig. 16B*

PERSONAL DISPOSABLE EMERGENCY BREATHING SYSTEM WITH DUAL AIR SUPPLY

RELATED APPLICATIONS

This application is a continuation-in-part of application Ser. No. 07/710,812, filed Jun. 5, 1991, now U.S. Pat. No. 5,186,165, issued Feb. 16, 1993, and application Ser. No. 07/984,529, filed Dec. 2, 1992, now U.S. Pat. No. 5,315,987, the disclosures of which are incorporated herein by reference.

TECHNICAL FIELD

This invention relates to a compact, self-contained, low-cost, integrated disposable emergency breathing system, for use, for example, in the personal oxygen life support delivery system in an aircraft. Briefly, the invention provides a single canister containing a protective hood, a multi-stage air purifying chemical filter attached to the hood for filtering ambient air (e.g., aircraft cabin air), an air flow conduit for releasable securement to a source of breathable air, e.g., an aircraft's oxygen supply system, and a valved mouthpiece complete with attached noseclip, within the hood, all sealed within the canister until opened for use. The canister is deployable from a compartment, e.g., an overhead compartment, for use by aircraft passengers. When the canister is deployed and opened, e.g., by the passenger, the hood is drawn about the individual's head and breathing is effected through the mouthpiece. The multi-stage filter is open to ambient air and is designed to filter toxic polar organic gases, convert carbon monoxide to carbon dioxide and, as an alternative, oxygen, and provide filtered breathable air for life support for a period of time, for example, in excess of 10 minutes. Additionally, the air flow conduit flows air from the external source for mixing with the filtered air whereby both filtered air and air, e.g., oxygen from the external source are simultaneously supplied the individual. Subsequently, the canister may be disconnected from the external source of air whereby the individual may evacuate the area breathing only filtered ambient air.

BACKGROUND

While conventional personal emergency breathing systems have been designed for use in fires and have addressed the problem of removing carbon monoxide and other toxic gases, i.e., cyanides, benzines and the like, they fail to provide a low-cost, one-piece system that integrates a protective hood, mouthpiece and filter in a single compact canister. Nor are such systems adaptable for specific environments, such as emergency life support systems for aircraft. In such conventional systems, the hood has been either an incidental independent feature of the filter system or has been attached in a separate package to be used or not used by choice. Such hoods have invariably been of a bulky design generally incorporating a solid heat-resistant material forming the main part of the body of the hood, severely restricting two-way communication, and provided with a transparent window of a size which substantially restricts vision and is subject, as a consequence of its limited area, to fogging. Such a design requires the hood to be packed and carried separately.

Prior art emergency breathing systems typically exhaust exhaled gases via a one-way valve to atmosphere, or back into the filter via the mouth or mouth/nose piece. Consequently, prior art systems have required a rubber/plastic face forming a nose/mouth cover or a mouthpiece and noseclip. These devices are not efficient, particularly when used on bearded or children's faces. Similarly, mouthpieces with a separate noseclip are inconvenient and, unless placed properly on the nose, are subject to being easily dislodged and lost.

Prior art systems are often bulky, sometimes require sizing for fitting particular individuals, and generally are not conductive to easy or practical day-to-day carriage or storage. Prior art systems also have employed a variety of fitting methods generally relying on multiple or single-strap arrangements requiring individual adjustment to ensure a proper airtight fit to the individual user. In an emergency or panic situation, such methods are time-consuming and sometimes confusing to use, especially in the case of multiple-strap arrangements. Certain prior art systems do not provide a protective hood or face mask and are complicated in design or use or both. Additionally, such systems are expensive to manufacture, do not lend themselves to a low retail cost, and hence are effectively precluded from a cost standpoint from prepositioning in the necessary numbers in populated areas. Nor are those systems adaptable for use in specific environments, for example, in an emergency personal life support system for an aircraft.

DISCLOSURE OF THE INVENTION

In light of the failings of conventional systems as described above, and according to the present invention, there is provided a simple to use, one-time use, low-cost, compact personal emergency breathing system, particularly for use in an emergency life support system in an aircraft, and including an integral transparent hood, mouthpiece, passive chemical filter, discrete conduits for flowing filtered ambient air and air from a non-ambient external source to the individual, all housed in a single compact canister and able to provide, when used, life support for a period of time sufficient to enable the user to escape from an area containing toxic or noxious gases, such as smoke from a fire.

Generally, the disposable emergency breathing system of the present invention provides a canister for disposition in and deployment from a compartment, for example, an overhead compartment in an aircraft. The canister includes a generally cylindrical body housing a filtration unit containing filtering material, a hood and a mouthpiece complete with an attached noseclip, the housing being closed at one end by a cover, as well as an air flow conduit bypassing the filtration unit and connected to an external source of air, e.g., an oxygen supply. In one embodiment of the present invention, the end of the body opposite the cover has at least one air inlet aperture normally sealed by a plastic air-tight push fit seal or a removable adhesive metallic foil, whereby the ambient air inlet to the canister and filtering material is normally closed when the system is not in use and stored in the compartment. The filtering material is preferably disposed in layered form within the body of the canister and preferably comprises a layer each of activated charcoal granules, a dessicant and a catalyst for the catalyzation of carbon monoxide to carbon dioxide, each layer being preferably separated by an electrostatically charged fabric filter for collecting particulate matter. Also, a layer of lithium peroxide or other suitable chemical may comprise a fourth layer for converting carbon dioxide to oxygen. Thus, the layered filtering material is disposed within the body of the canister in a manner such that, when the air inlet aperture or apertures are uncovered, air will flow through the apertures and through the charcoal granules, dessicant and catalyst, preferably in that order, and also through the electrostatically charged filters.

Between the filtering material and the cover for the canister, there is provided a mouthpiece connected to a plenum sealingly secured about the margins of the canister body for receiving filtered air from the filtration stage for transmission to the mouthpiece and also air from the external source as explained below. The mouthpiece contains a one-way inhalation check valve and at least one one-way exhalation check valve, preferably complete with a small integral whistle. Additionally, the mouthpiece preferably carries a noseclip pivotal between a stored position within the canister and a use position pivoted away from the mouthpiece. The mouthpiece and noseclip are enclosed within a wholly transparent hood, likewise sealingly secured about its margins to the canister body. Thus, the mouthpiece, noseclip and hood are secured within the canister body between the filtration stage and the cover when the system is stored and not in use.

Additionally, to adapt the system for use as part of the personal emergency oxygen supply in an aircraft, an air flow conduit is provided in the canister which bypasses the ambient air flow through the filtration unit. The air flow conduit has an air flow inlet for connection with an external source of breathable air, for example, an oxygen supply carried by the aircraft. The air flow conduit also includes an air flow outlet for delivering breathable air from the external source directly to the mouthpiece. Preferably, the air flow inlet of the conduit has a quick connect/disconnect coupling with a flexible conduit in the overhead aircraft compartment which, in turn, is connected to the aircraft oxygen supply. The canister in the compartment is connected to a normally closed valve in the oxygen supply line by a lanyard. Additionally, the quick connect/disconnect coupling has a pair of valves for respective retention with the flexible conduit and the canister upon disconnection of the canister from the flexible conduit.

To use the system, for example, in an aircraft cabin depressurization emergency, the canister is deployed from the overhead compartment, being connected thereto by both the flexible conduit and the lanyard. By yanking the lanyard or canister, the lanyard opens the valve to supply air, e.g., oxygen, from the external source to the air flow conduit in the canister. The mouthpiece carrying the noseclip and the hood within the canister are then deployed by the individual by removing the cover of the canister whereby the hood and mouthpiece with noseclip are automatically extended from the canister body. The plastic push fit seal or adhesive-backed metallic foil of one embodiment hereof is also removed to expose the air inlet aperture or apertures and hence the filtration stage to ambient, e.g., aircraft cabin, air. The hood has a full width opening for drawing it about the individual's head, the opening preferably having an elastic closure or draw band for drawing and substantially sealing the opening about the individual's neck. With the mouthpiece inside the hood, the individual may then place the mouthpiece in his/her mouth and swing the noseclip from its stored position into a use position about the nose whereby normal breathing may be maintained. Upon inhalation, ambient air entering the canister through the air inlet aperture flows through the filtering material into the plenum and passes through the one-way inhalation check valve to the mouthpiece. Air from the external source, i.e., oxygen from the aircraft oxygen supply system, simultaneously flows through the air flow conduit into the plenum and mixes with the filtered air.

Upon exhalation, air flows from the individual's mouth into the mouthpiece and through the exhalation check valve(s), one of which preferably supports an integral whistle, into the hood, the inhalation valve being closed, by virtue of its design, during exhalation. By flowing exhalation air into the hood, a positive pressure within the hood is established. Consequently, the noxious and toxic air, smoke particles and the like, e.g., from a fire within the aircraft cabin, cannot enter the hood through the draw band or elasticized hood opening, notwithstanding that a complete seal is not formed between the hood opening and the individual's neck.

The filter stage of the invention is designed to remove toxic/organic gases, thereby affording life support and protection against asphyxiation in order to allow a panic-free evacuation from a fire or smoke-filled area after disconnection of the air flow conduit from the external air source as explained below. The filtered ambient air is thus designed to supplement the aircraft's plumbed oxygen supply which is altitude-dependent and often inadequate. Thus, any shortfall is made up by ambient air filtered by the filtration unit.

The transparent hood and mouthpiece of the invention are provided in one size which fits all individuals. Particularly, the transparent hood envelops the individual's entire head and is substantially sealed around the neck, thereby protecting the individual's eyes against the effects of smoke and flames and preventing inhalation of toxic gases. In doing so, the hood also provides unrestricted visibility.

As aforementioned, the mouthpiece is provided with one-way inhalation and exhalation valves. The valves are arranged so that air drawn through the filtration stage and inhaled through the mouthpiece does not, upon exhalation, flow back through the filter. Rather, exhaled air is exhausted from the mouthpiece through the exhalation valve or valves into the interior of the above-described hood. In this way, the hood has a slight positive pressure whereby external noxious and toxic gases at ambient pressure are unable to enter the hood even if the neck seal is incomplete or the hood is damaged. Exhaled gases within the hood are thus released at a natural rate through the neck seal. Conversely, the exhalation valve or valves close upon inhalation, thus preventing backflow of exhaled air within the hood into the mouthpiece or filtration stage.

It is a feature of the present invention that the canister may be disconnected from the external source of breathable air whereby the individual using the system may evacuate the area of the flame and toxic fumes, e.g., an aircraft cabin, while retaining the ability to breathe filtered ambient air during the evacuation. To accomplish this, the quick connect/disconnect coupling is activated by the individual to disconnect the canister from the external source of air, the lanyard carried by the canister being previously disconnected from the valve stays with the canister. The quick connect/disconnect coupling includes a pair of valves which are retained by the coupling and canister, respectively. Upon disconnection, the valve retained by the flexible conduit closes to close the supply of air from the external source. The valve in the canister also closes to prevent flow of ambient air into the plenum. In this manner, only ambient air which flows through the filtration unit is provided the plenum and mouthpiece subsequent to disconnection of the canister from the external air supply.

In a still further preferred embodiment hereof, the filtering material is contained within a filtration unit housing separate from the canister body. In this form, the filtration housing has an open bottom end and is disposed on ribs upstanding from the closed lower end of the canister body. Additionally, the filtration housing is spaced within and from the interior wall surfaces of the canister body to define an annular passage. The plenum, mouthpiece, hood and check valves are as previously described, except that the plenum and hood are secured about the upper end of the filtration housing by a securing ring. The filtration housing is secured within the canister body via internal guides and a press fit. The securing ring has a plurality of openings affording communication between the upper end of the canister body and the annular passage. In this form, when the lid to the canister body is removed, the opening into the canister body serves as an air inlet enabling air to flow through the apertures in the securing ring, downwardly through the annular passage and into the opening at the lower end of the filtration housing for passage through the filtering material. In another form, the filtration section, including the inner and outer canister as described above, is provided with twist-on, twist-off type bayonet fittings to allow the easy replacement of the filter section while in use. In this way, extended life support is provided to the user.

In this latter embodiment, turbulence promoters are formed on one or both of the wall surfaces of the canister body and filtration housing defining the annular passage. These turbulence-creating surfaces encourage the large particles entrained in the polluted air, such as soot, to adhere to the walls. In this manner, the large particles do not flow to the inlet of the filtration housing which thus remains free and unclogged of such particles. A significant advantage of the foregoing embodiment is that only the lid needs to be removed from the canister body in order to permit air to enter the breathing system. Thus, upon removal of the lid and donning the hood, the user is able to automatically breathe filtered air initially entering the system from the surrounding environment through the canister body opening, as well as air from the external air source. In this form, a chemical light, in the form of a disk, is also disposed on the bottom of the housing. By pressuring the chemical light, it becomes activated to assist rescuers in locating the user of the system whilst also providing some aid and comfort to the user.

In a preferred embodiment according to the present invention, there is provided a personal emergency breathing system for filtering ambient air and flowing breathable air from an external source other than ambient air comprising a canister having a body with an opening and a cover normally closing the opening, an air filtration unit disposed within the body of the canister for filtering ambient air and having an air inlet for receiving ambient air and an air outlet, the ambient air being receivable through the air inlet into the filtration unit where it is filtered and passed through the air outlet, a mouthpiece carried by the canister for receiving filtered air from the outlet of the filtration unit, a hood carried by the canister and enveloping the mouthpiece, the mouthpiece and the hood being disposed in a collapsed condition in the canister adjacent the opening and between the cover and the filtration unit whereby, upon opening of the cover, the hood and the mouthpiece being deployable from the canister through the opening to a location external to the canister, the hood having an opening for receiving an individual's head and neck whereby the hood, when deployed, may envelop an individual's head. Means are provided for connecting the hood and the mouthpiece to the canister in the collapsed condition and when deployed. Means are also provided establishing an air flow path from the air outlet to the mouthpiece when the hood and the mouthpiece are deployed enabling flow of filtered air from the filtration unit air outlet to the mouthpiece and preventing flow of filtered air from the filtration unit air outlet into the hood. An air flow conduit is also carried by the canister body bypassing the filtration unit and has an air flow inlet for connection with an external source of breathable air other than ambient air and an air flow outlet, the air flow outlet lying in communication with the mouthpiece whereby the air flow conduit enables flow of air from the external source of breathable air into the mouthpiece when the hood and the mouthpiece are deployed and without the air from the external source passing through the filtration unit.

In a further preferred embodiment according to the present invention, there is provided a personal emergency breathing system comprising a compartment, a canister disposed in the compartment and deployable therefrom, a flexible external air supply conduit disposed in the compartment with the canister for connection to a source of breathable air other than ambient air, the flexible conduit being connected to the canister, and at least in part, being deployable from the compartment with the canister. A normally closed valve is provided for precluding air flow from the external source to the canister. The canister has a body with an opening and a cover normally closing the opening. An air filtration unit disposed within the body of the canister is provided for filtering ambient air and has an air inlet for receiving ambient air and an air outlet, the ambient air being receivable through the air inlet into the filtration unit for filtering and passage through the air outlet. A mouthpiece is provided carried by the canister for receiving filtered air from the outlet of the filtration unit, a hood being carried by the canister and enveloping the mouthpiece, the mouthpiece and the hood being disposed in a collapsed condition in the canister adjacent the opening and between the cover and the filtration unit whereby, upon deployment of the canister from the compartment and opening the cover, the hood and mouthpiece are deployable from the canister to a location external to the canister. The hood has an opening for receiving an individual's head and neck whereby the hood, when deployed, may envelop the individual's head. Means are provided connecting the hood and the mouthpiece to the canister in the collapsed condition and when deployed therefrom. An air flow conduit is carried by the canister body bypassing the filtration unit and has an air flow inlet and an air flow outlet, a releasable coupling connecting the air flow inlet and the flexible external air supply conduit, the air flow outlet lying in communication with the mouthpiece whereby the flexible external air supply conduit and the air flow conduit enable flow of air from the external source of air into the mouthpiece when the canister is deployed from the compartment and the hood and the mouthpiece are deployed from the canister and without the air from the external source passing through the filtration unit. Means are provided for opening the normally closed valve when the canister is deployed from the compartment to flow air from the external source into the mouthpiece.

Some of the unique features of the invention and its objects include: (1) in its unused form, the multi-stage filter chemicals are protected and their purity maintained within the sealed airtight canister; (2) the aforedescribed transparent hood and mouthpiece complete with the described valve system and, preferably also a noseclip, are disposed within the upper section of the canister which is normally closed by means of a "twist-off" cap/lid; (3) when in use, multiple small apertures or, in the case of a single plastic push-type seal, a large single aperture in the lower bottom of the canister are provided in one embodiment hereof to allow polluted air to be drawn into and through the filter section and when not in use, are covered and made airtight by a removable adhesive metal foil seal or a single plastic-type seal which maintains the airtight integrity of the canister body and particularly the filtration stage; (4) the "twist-off" lid is designed to ensure positive removal when twisted or turned in either direction by a sloped ramp at the extremities of the retaining groove thereby ensuring that the lid will separate/eject cleanly from the container when fully twisted in either direction without the risk of becoming jammed; (5) the "twist-off" lid, in another embodiment hereof, not only has the foregoing features, but also serves to open the air inlet to the filter, upon removal of the lid, to enable ambient air to pass downwardly through the annular channel between the housing body and filter canister and through the filter canister with the turbulence promoters in the annular channel preventing or inhibiting flow of large soot particles to the filter; (6) the hood material is formed of "Kapton" and is heat-resistant up to 900° F. and is light, fully transparent, does not restrict the passage of voice communications or sound, and is readily amenable to folding and packing into the upper section of the canister; (7) the full width neck aperture of the hood is elasticized or provided with a "draw tape" and clearly marked by a highly visible strip of color; (8) by providing a "one-size-fits-all" hood design, children, adults, bearded or beardless individuals, or individuals wearing optical glasses can be accommodated; (9) the casing material is coated with a luminescent material, thus providing a means of easy location and identification in the dark; (10) the system has an extended shelf life, is recyclable, disposable, extremely low-cost, of unitized construction and has sufficient air filtration capacity, e.g., in excess of ten minutes, to enable individuals to escape areas containing polar or non-polar noxious or toxic gases; (11) an exhaust valve is provided with a whistle to alert potential rescuers to the location of the individual using the present system and which whistle may be activated by sharp exhalation; (12) a chemical light is disposed at the bottom of the canister body to likewise assist in the location of the individual and to provide some assistance to the user in restricted visibility; (13) the canister is also adapted for connection to an external source of air, e.g., oxygen, whereby air from the external source as well as filtered ambient air may be provided the individual; and (14) the canister is readily disconnected from the external source of breathable air whereby the system remains useful to supply filtered ambient air as the individual evacuates the smoke-filled area.

These and further objects and advantages of the present invention will become more apparent upon reference to the following specification, appended claims and drawings.

BRIEF DESCRIPTION OF THE DRAWINGS

FIG. 1 is a side elevational view of a personal disposable emergency breathing system according to the present invention and illustrating a canister containing various elements of the system prior to use;

FIG. 2 is a schematic side elevational view of the breathing system in use by an individual;

FIG. 5 is an enlarged cross-sectional view of a portion of a breathing system, including the mouthpiece, attached noseclip, exhalation and inhalation check valves and the plenum;

FIGS. 6A and 6B are respective cross-sectional and plan views of a fixed valve seat forming part of the inhalation valve;

FIGS. 7A and 7B are respective side elevation and bottom plan views of a flexible valve member for the inhalation valve illustrated in FIG. 5;

FIGS. 8A and 8B are plan and vertical cross-sectional views of a fixed valve seat forming part of each exhalation valve on opposite sides of the plenum as illustrated in FIG. 5;

FIG. 13A is a fragmentary cross-sectional view illustrating, in a further embodiment hereof, the connection between the various parts of the canister body;

FIG. 13B is a view similar to FIG. 13A illustrating a further embodiment of that connection;

FIG. 14 is a fragmentary perspective view illustrating a pull tab recessed into the body of the canister for opening the air inlet aperture;

FIG. 16A is a bottom plan view of an overhead compartment in an aircraft illustrating the positioning of a canister of a breathing system hereof in the compartment and its connections therewith;

FIG. 16B is an elevational view illustrating the deployment of the canister from the compartment.

BEST MODE FOR CARRYING OUT THE INVENTION

Reference will now be made in detail to a present preferred embodiment of the invention, an example of which is illustrated in the accompanying drawings. The present description will proceed as in the co-pending application Ser. No. 984,429, describing two embodiments of the personal emergency breathing system hereof without connection to an external source of air other than ambient air, followed by a description of the adaptation of both embodiments for simultaneously flowing filtered ambient air and air from an external non-ambient air source to the user and subsequent disconnection from the source of external air whereby the user breathes only filtered ambient air.

Figure 10:
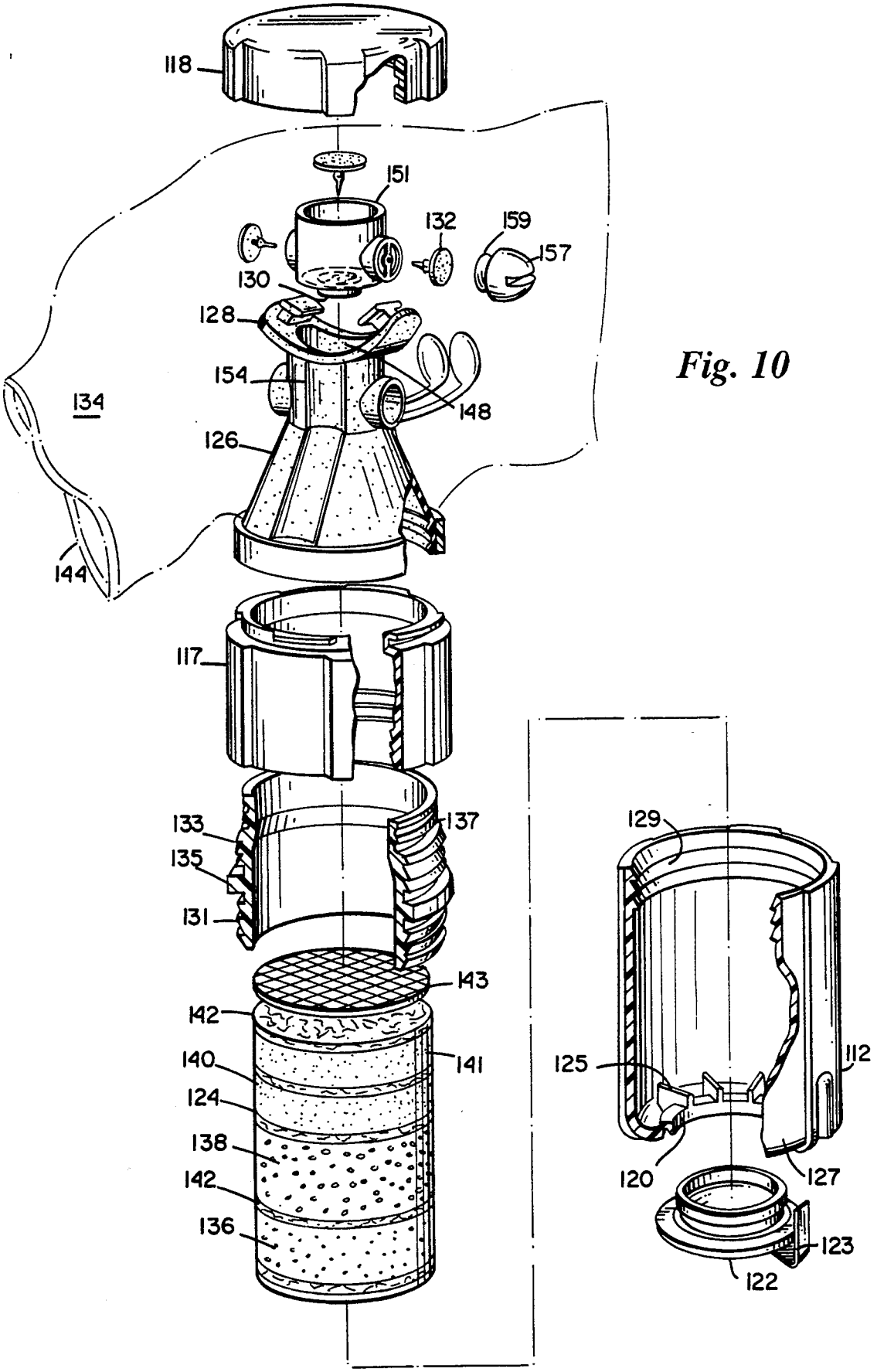
FIG. 10 is a view similar to FIG. 1 illustrating another embodiment of the present invention.

Referring now to the drawing figures, particularly to the embodiment of FIG. 1, there is illustrated a personal disposable emergency breathing system, generally designated 10, and illustrated in a non-used or stored condition and including a canister 12. Canister 12 includes a body 14 having an intermediate securing ring 16 and a cover 18. Canister 12 is preferably formed of a color-impregnated, flame-retardant plastic material such as ABS. Canister body 14 is closed at its lower end, except for one or more apertures 20 (FIG. 3), which serve as an air inlet for the emergency breathing system as detailed hereinafter. In this embodiment, apertures 20 are normally closed by a metallic foil 22 releasably adhesively secured to the bottom of canister body 14, sealing the apertures 20. A pull tab 23 is provided for removing the sealing foil 22. A plastic push-type seal, as illustrated in FIG. 10, may also be used in lieu of the foil seal.

Figure 3:
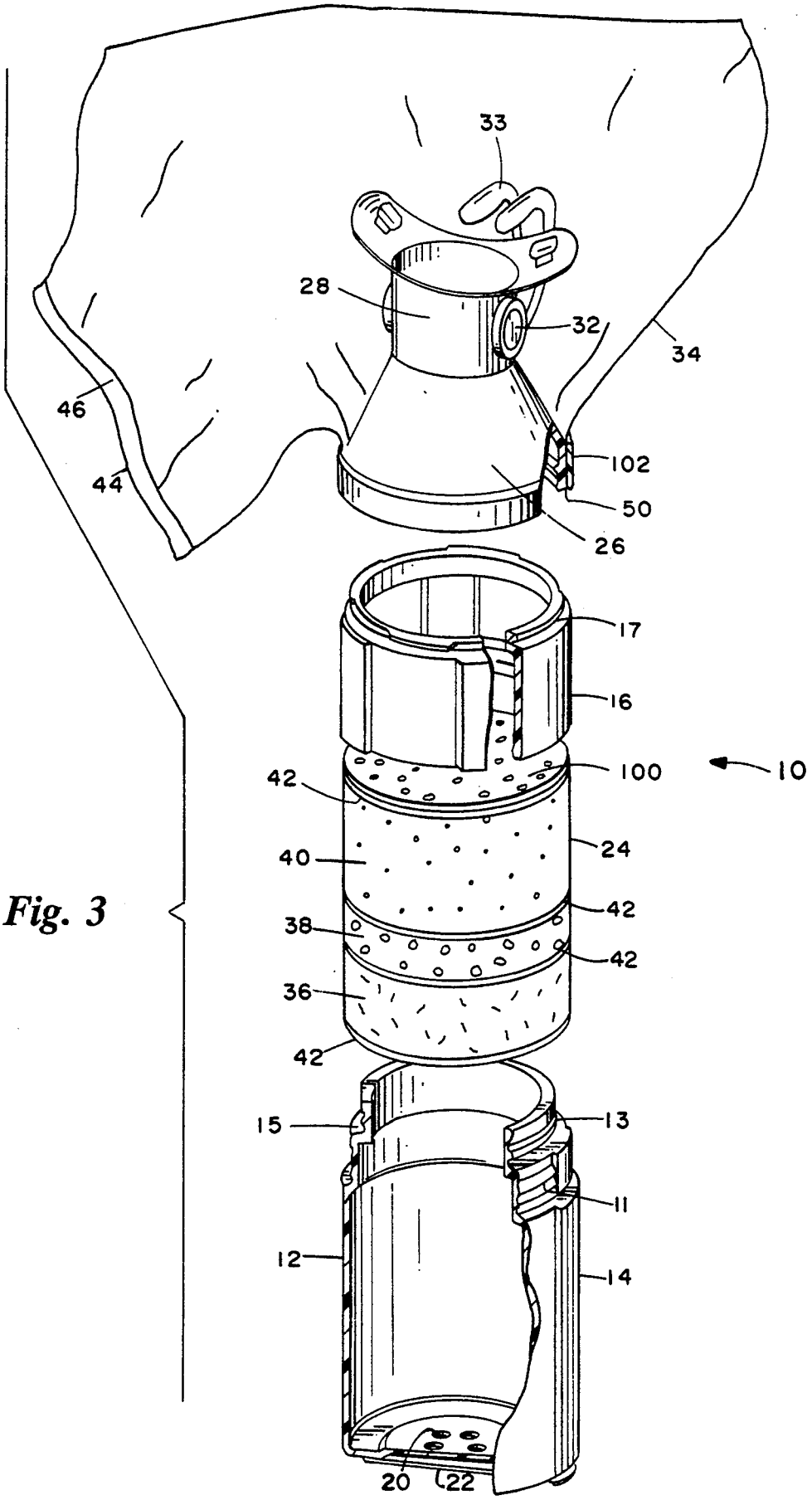
FIG. 3 is a fragmentary exploded perspective view with parts broken out and in cross-section of various elements of the breathing system hereof.

Referring to FIG. 3, breathing system 10 basically includes the canister 12, a filtration section 24, a mouthpiece 28 with a noseclip including a plenum 26 for conveying inhalation gas from filtration section 24 to mouthpiece 28, the latter carrying inhalation and exhalation check valves 30 and 32, respectively (FIG. 4), and a noseclip 33. A transparent hood 34 is also provided. These components of the system are disposed within canister 12 when the open end of the canister is closed by cover 18 whereby the elements are substantially sealed from the atmosphere. More specifically, the hood 34 and mouthpiece 28 are folded into ring 16 which is attached to canister 12. When the cover 18 is removed, the plenum 26, mouthpiece 28 and hood 34 may be automatically deployed from (but remain connected to) canister 12.

In this first embodiment, canister body 14 has stepped reduced diameter portions 11 and 13 adjacent its upper end. First reduced section 11 includes a plurality of vertically spaced, interrupted, downwardly tapered portions for securing complementary interrupted downwardly tapered portions formed along the inside surface of ring 16. The second reduced step portion 13 includes a pair of grooves 15 for receiving the annular portion of a collar 50 described hereinafter. The upper end of ring 16 includes interrupted radially outwardly projecting flanges 17 which facilitate releasable connection with complementary flanges on the inside of cover 18 upon rotation of cover 18 in either rotary direction.

Figure 4:
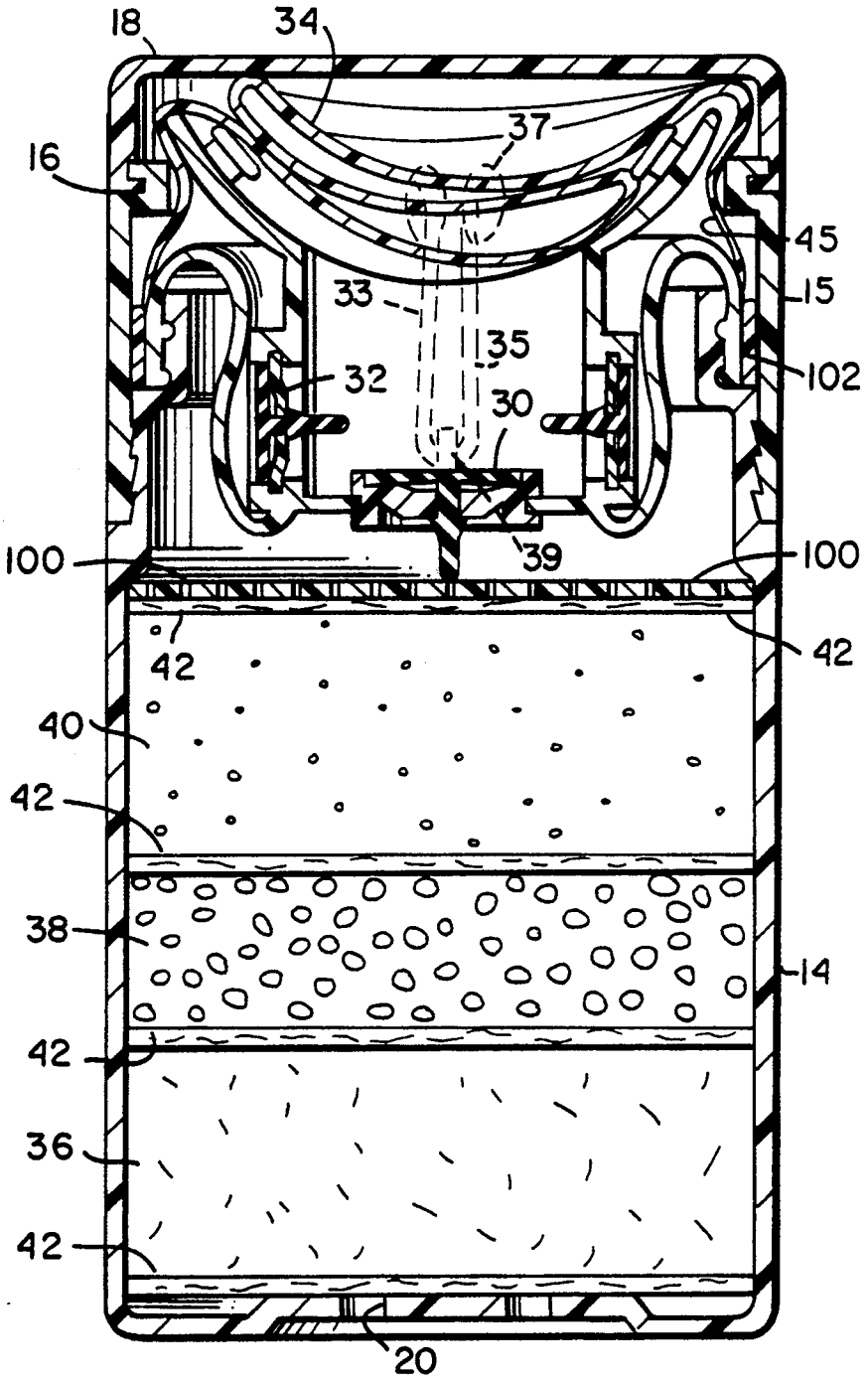
FIG. 4 is an enlarged vertical cross-sectional view of the breathing system illustrated in FIG. 1.

Turning now to FIGS. 3 and 4, the filtration section 24 preferably comprises layers of air-filtering material. Particularly, the filtering materials are preferably arranged in stages, the first stage 36 comprising activated carbon granules, e.g., Calgon-type ASC Grade III activated carbon granules (12×30 mesh). The carbon granules are provided for the purpose of removing from the air inlet to the breathing system the polar organic gases, e.g., benzenes, cyanides and the like, as found in dense smoke of a typical fire, where natural, man-made and synthetic materials are burning. The intermediate filtration stage 38 is comprised of a dessicant to remove moisture from the inhaled air or gas before it passes into the final stage of filtration section 24. The dessicant may be a zeolite type Z 3-01/3A (8×12 mesh, 1–2 mm). The final stage 40 of filtration section 24 is formed of a material which converts carbon monoxide to carbon dioxide by a catalyzation process. Such material may preferably comprise a carulite type 200, a copper manganese oxide hopkalite catalyst. A fourth step, for example, containing lithium peroxide or other suitable chemical, may be added for converting carbon dioxide to oxygen.

Separating the layers 36, 38 and 40 of filtration stage 24 and also disposed at opposite ends of the filtration stage are electrostatically charged fiber filters 42. These filters comprise a woven or unwoven fabric of synthetic fiber which has been charged with static electricity and is capable of collecting and absorbing particulate matter, for example, minute particles of smoke. Such filters are commonly referred to as electret filters. Alternatively, metal grids may be used as separators and the fiber filters used at the top and bottom of the filter stages.

Preferably, the layers of filtration material, including the electrostatically charged fabric filters, are disposed in the canister body 14 in the order illustrated in order to provide efficient removal of the noxious gases. In order to provide for efficient operation of the breathing system for a period of at least 10 minutes, it has been determined that a quantity of about 10 grams of activated carbon granules, about 55 grams of the zeolite dessicant, and about 80 grams of the carulite catalyst, together with at least one non-woven electrostatically charged filter is sufficient to reduce, during that period, the levels in the incoming air of carbon monoxide to 244 ppm, hydrogen chloride to 0 ppm, oxides of nitrogen to 12 ppm and hydrogen cyanide to 0.5 ppm. These reductions are achieved for air flow rates of approximately 40 liters per minute, i.e., approximately equivalent to the demand of an individual fast walking. The electrostatically charged filter also virtually removes all smoke-related particulates from the air. It will be appreciated that these filtration materials may be provided in different amounts than set forth above, may be provided in a different order, and have indefinite shelf lives, provided they are hermetically sealed within canister 10 as described hereinafter. Consequently, it is necessary that the adhesive metal foil seal or plastic push-type seal 22 and connections between the body 14 and ring 16 provide effective seals as described hereinafter.

Hood 34 is formed of a clear, heat-resistant plastic material, such as Kapton, of such characteristics that it does not impede the passage of sound and thus allows two-way communication. The hood 34 has a first full width opening 44 sufficient to pass over an individual's head whereby hood 34 completely envelops the user's head. The opening 44 is provided with an elastic fabric or draw-type tie band 46, preferably colored, which, after hood 34 is drawn over the individual's head, forms a substantial seal about the individual's neck. The hood has a second opening 45 which is sealed to the canister during manufacture and is maintained in both storage and deployment of the system, as described hereinafter in detail.

Referring now to FIGS. 3, 4 and 5, mouthpiece 28 and plenum 26 define an air passage 48 from the filtration section 24 to the user's mouth. Plenum 26 and mouthpiece 28 are integrally formed, preferably of a flexible material, such as rubber. Plenum 26 includes a lower annular collar 50 having radially inwardly directed, axially spaced ribs 52 (FIG. 5) which mate with ribs 15 on canister body 14 when assembled. Plenum 26 tapers elliptically from annular collar 50 to form a generally elliptical mouthpiece section 54 in communication with plenum 26 through inhalation check valve 30. Mouthpiece 28 also includes an arcuate portion 56, optionally with rubber molded teeth clamps, about the elliptical opening, portion 56 being receivable within the user's mouth for breathing purposes. Adjacent the juncture of plenum 26 and elliptical section 54, there is provided an inwardly directed, integrally extending wall 58, the inner edges of which are received in a fitting 60 forming part of inhalation valve 30. Fitting 60 comprises an annulus 62, preferably formed of a plastic material, having a diametrically extending central portion 64 and a central opening 66. A flexible valve member 68 having an integral stem 70 and a disk-like flap valve 72 is provided, preferably formed of rubber. Stem 70 passes through central opening 66 and is secured by a shoulder butting the underside of element 60. Valve 72 is disposed in seat 74 of valve member 60. Consequently, the one-way inhalation valve enables air in plenum passage 48 to pass through the valve into mouthpiece 28 during inhalation in response to the negative pressure on the upper side of valve 30 in FIG. 5 but prevents exhalation through valve 30 by seating flap 72 in seat 74 in response to positive exhalation pressure on the upper side thereof.

A pair of identical exhalation valves 32 are disposed on opposite sides of the elliptical section 54 of mouthpiece 28. As illustrated in FIGS. 7 and 8, each valve comprises a generally rigid member 80 disposed in a flanged opening 82 in section 54. Member 80 comprises an annulus 84, a diametrically extending bridge section 86 and a central aperture 88. The movable valve member 90 has an integral stem 92 which fits through the opening 88 and a disk-like flap member 93 for disposition in valve seat 94. Consequently, exhalation pressure along the inside of valve member 90 causes the valve to open, while the pressure difference across the valve maintains the valve closed during inhalation.

A noseclip 33 is also pivotally secured to mouthpiece 28. Noseclip 33 comprises a wishbone configuration having legs 35, each terminating in nose pressure pads 37, and, at their apex, pivotally secured to mouthpiece 28 by passing through an apertured projection 39 carried thereby. Noseclip 33 is thus pivoted between a stored position against mouthpiece 28 (FIG. 4) and a use position swung away from mouthpiece 28 (FIG. 2).

When assembling canister 12, the filtration section 24 is disposed in canister body 12 by locating the fabric electrostatically charged filters in succession with the granular filtering materials disposed therebetween in the order indicated. A relatively rigid perforated plastic plate or coated metal grid 100 is interposed on top of the final fabric filter 42 underlying the shoulder in the first reduced portion of canister body 12 to maintain the filtration section 24 in body 12. The collar 50 of plenum 26 is disposed about the second stepped portion 13 of body 12, with ribs 52 engaging in grooves 15. The margin of hood 34 about its second opening 45 is disposed about collar 50 with mouthpiece 28 extending interiorly of the hood. A clamping ring 102 is disposed about this hood margin and collar 50 to clamp and seal the hood and collar about reduced diameter portion 13 of body 14. Intermediate ring 16 is then disposed on the canister body 12 with the tapered portions locking ring 16 to body 14. The rubber collar 50 is thus clamped and sealed between ring 16 and body 14 thereby, with hood 34, hermetically sealing the upper end of filtration section 24. The hood and mouthpiece are then folded within intermediate ring 16 and cover 18 is applied to the upper end of ring 16 whereby the filtration section, hood and mouthpiece are contained within canister 12.

To use the device, for example, in the event of a fire requiring immediate exit from smoke-filled areas, cover 18 is removed from the canister body by rotating it in either direction. Once removed, the hood and mouthpiece automatically deploy through the open end of canister 12. That is, the hood 34 automatically deploys as a consequence of the "zig-zag" folds of the hood unfolding when the cap 18 is removed. The integral rubber mouthpiece and plenum extends from its folded position as a consequence of its elastic memory when the cap 18 is removed. The user also removes metal foil seal 22 by grasping the tab and peeling the foil away from the bottom of canister body 12 whereby the aperture or apertures 20 may serve as an air inlet to the filtering material and user. The user then draws the hood over his/her head through opening 44 with elasticized band or draw tape 46 forming a substantial, but not air-tight, seal about the individual's neck. By virtue of the projection of the mouthpiece from the open end of canister 12, the user may readily insert mouthpiece 28 into his/her mouth, and the nose pads 37 about his/her nose, with all breathing then being conducted through the user's mouth.

Figure 9C:
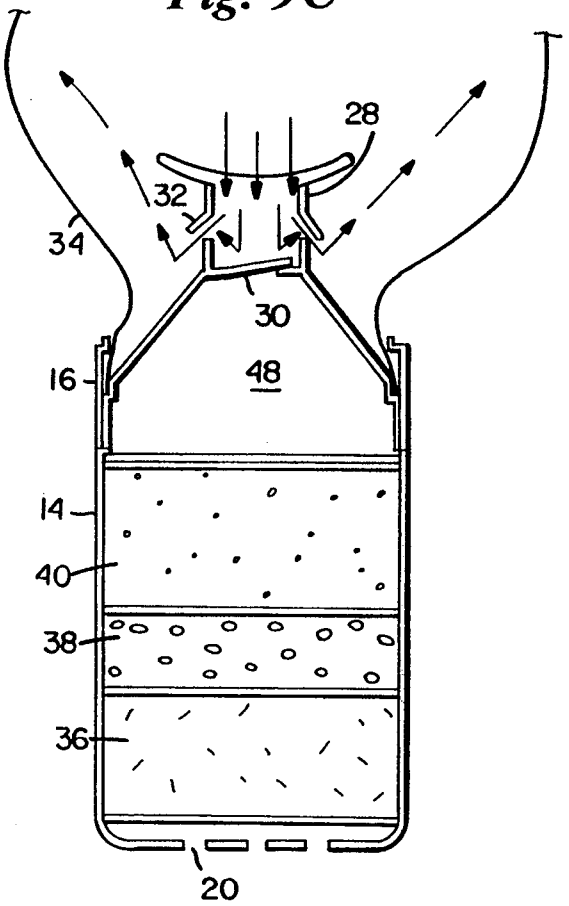
FIGS. 9A, 9B and 9C are schematic representations of the deployment of the mouthpiece and hood from the canister, the flow of inhalation gas and the flow of exhalation gas, respectively, of the emergency breathing system hereof.
Figure 9B:
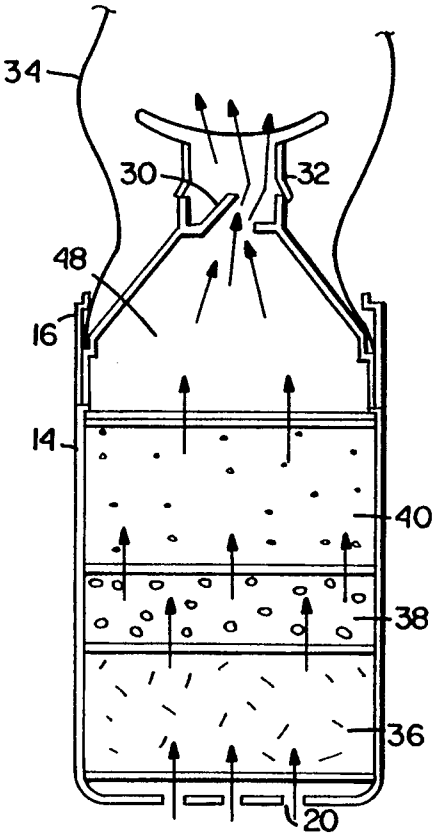
Figure 9A:
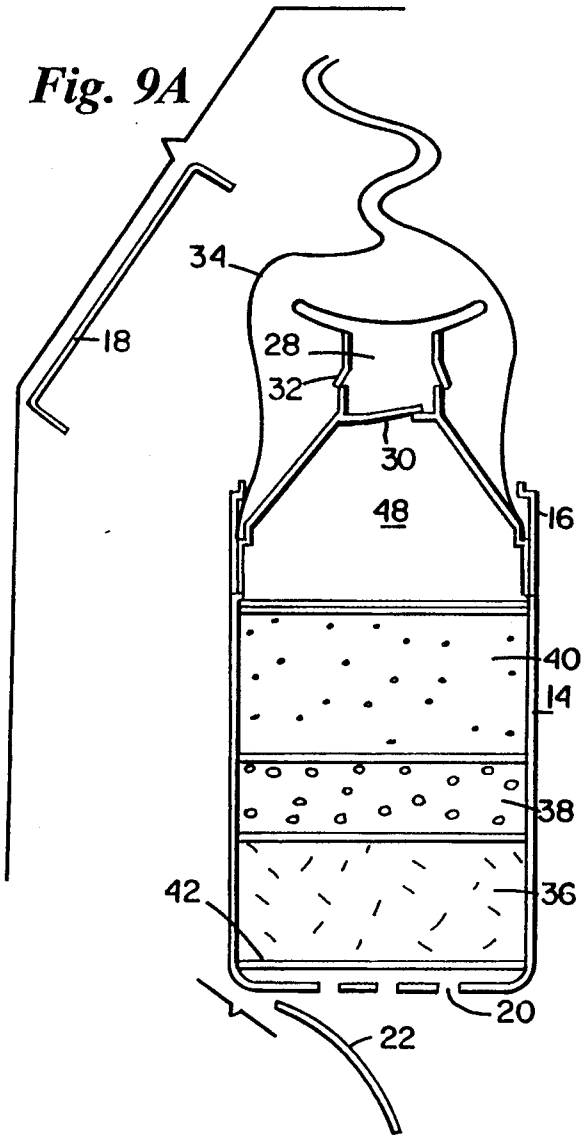

In FIG. 9B, it will be appreciated that upon inhalation, ambient air passes through the aperture or apertures 20 into the canister, through each of the layers of filtering material and through the electrostatically charged fabric. The filtered air is drawn into plenum 48 and inhalation check valve 30 opens to permit air to be inhaled by the user. Upon exhalation and with reference to FIG. 9C, the positive pressure of the exhaled air causes inhalation valve 30 to close and the exhalation valves 32 to open. Consequently, exhalation air flows from the mouthpiece through the exhalation valves into the interior of hood 34. By flowing exhalation air into the interior of the hood, a positive pressure is provided within hood 34, maintaining the body of the hood away from the individual's face, as well as preventing ambient air from entering the interior of the hood through any air leakage paths between the elasticized band or draw tape 46 and the individual's neck. In short, outflow of exhalation air from the hood through the leakage paths between band 46 and the user's neck prevents inflow of noxious or toxic gases through those same leakage paths into the interior of the hood. The foregoing-described breathing cycle is continually repeated, allowing the user to evacuate and escape from the area containing the toxic or noxious gases.

In one form of the invention, the filtering stage is comprised substantially entirely of activated carbon in conjunction with one or more electrostatically charged fiber filters at the top and/or bottom of the carbon. Additional electrostatic fiber filters may be provided as needed.

To provide a compact system and, simultaneously, a system which will provide at least, and preferably more than, 10 minutes of breathable filtered air for emergency situations, it has been found that the quantities of filtration material, identified above, will satisfactorily supply such breathable air. Those quantities, together with the configuration of the hood and mouthpiece, enable the canister to be relatively small in size. For example, a canister of that configuration may have an overall height of about 4-$\frac{7}{8}$ inches, an approximate diameter of about 2-$\frac{5}{8}$ inches, with a filter section length of about 3-$\frac{1}{8}$ inches. The length of the retracted plenum and mouthpiece may be approximately 1-$\frac{1}{4}$ inches and the extended length of the plenum and mouthpiece from the canister body would be 2-$\frac{3}{4}$ inches. Preferably, cap 18 and ring 16 are flanged to permit removal of the cap upon a 45° turn of the cap in either direction. Additionally, the canister, being formed of special ABS plastic, has a heat resistance in excess of 200° F. The heat resistance of the plastic hood is 900° F. approximately.

Figure 11:
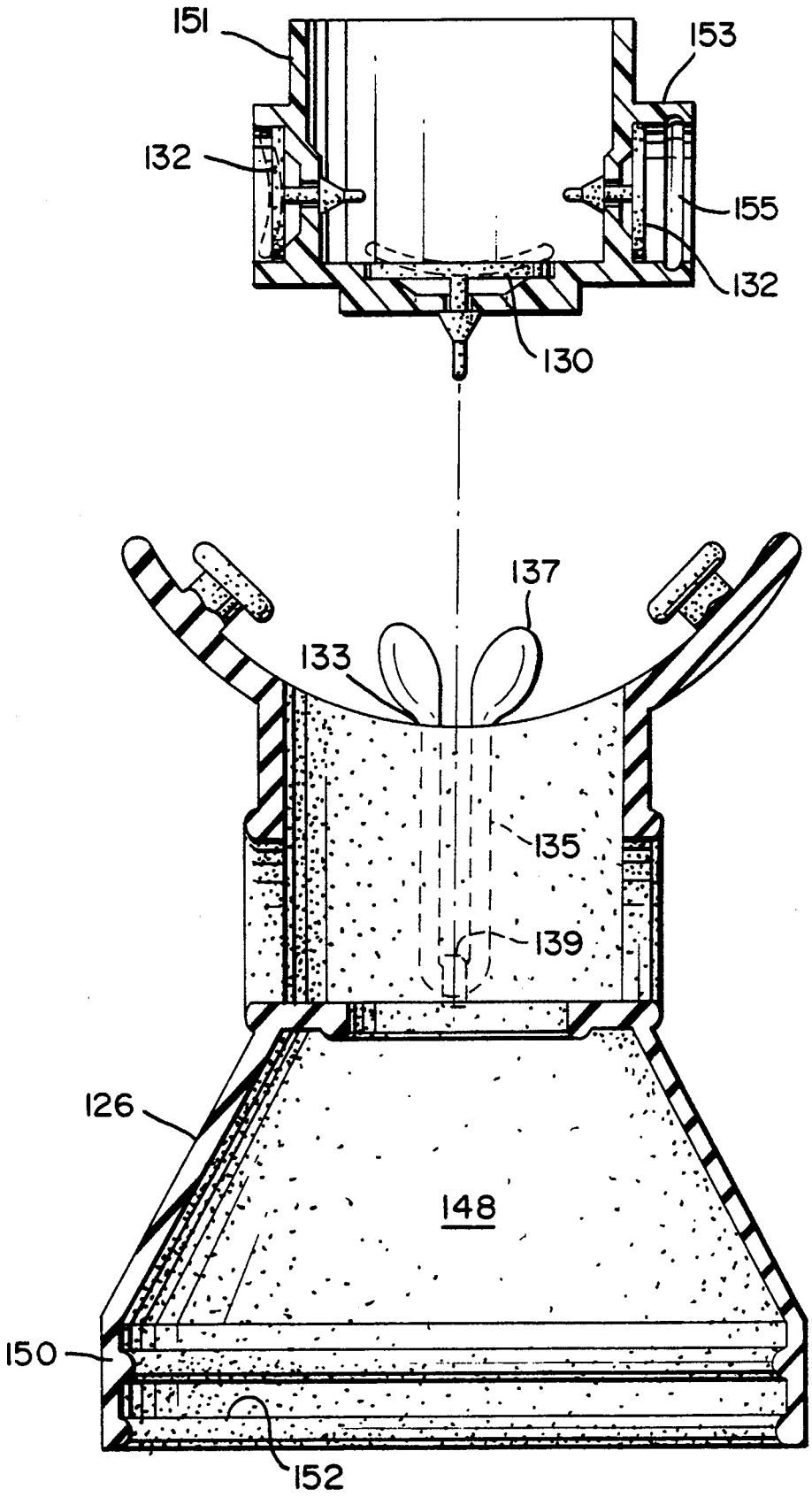
FIG. 11 is an enlarged exploded cross-sectional view of a portion of the breathing system of FIG. 10 including the mouthpiece, exhalation and inhalation check valves and the plenum.
Figure 12:
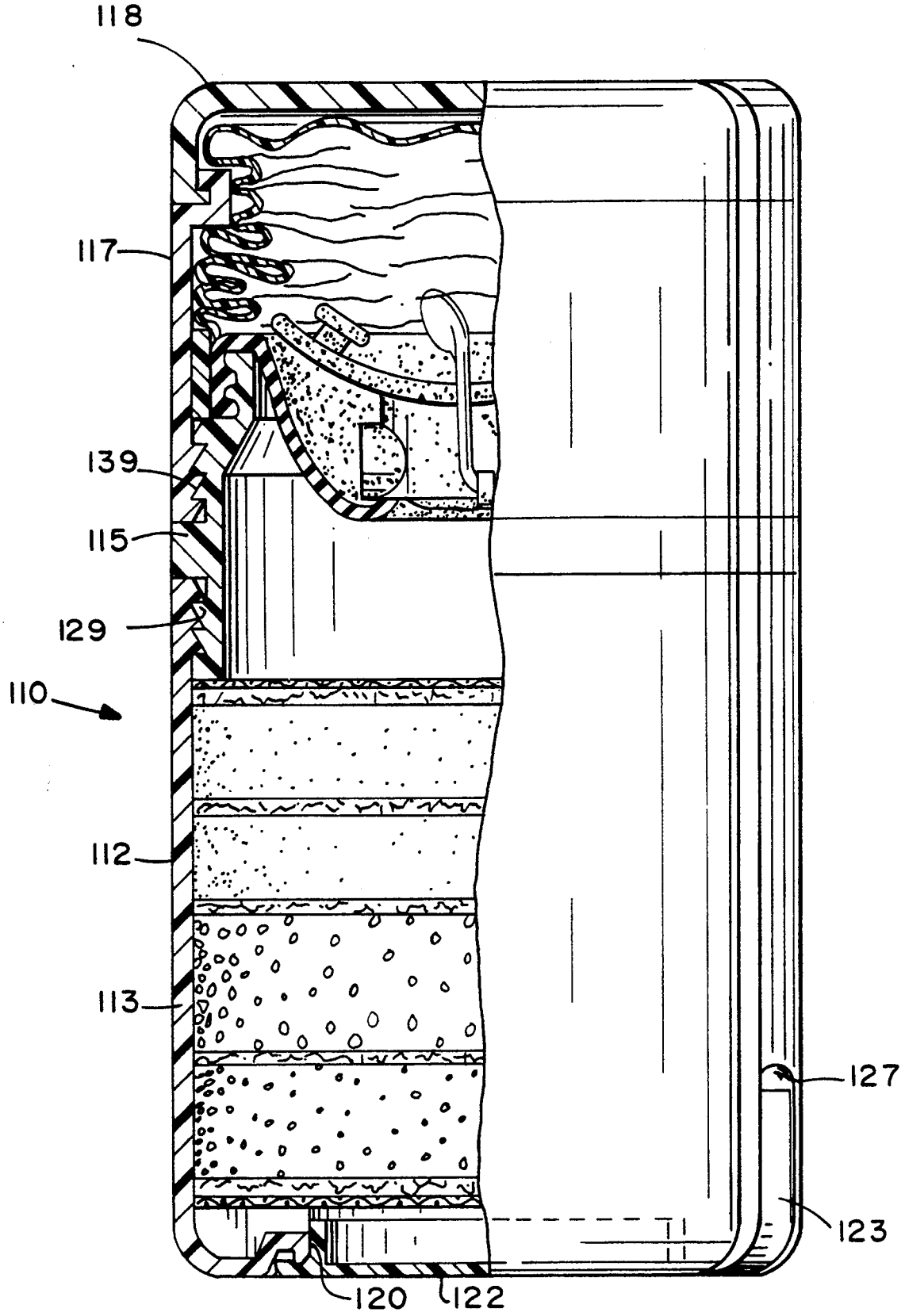
FIG. 12 is an enlarged side elevational view with parts broken out and in cross-section of the breathing system of FIG. 10 in a stored and unused condition.

Referring now to the embodiment hereof illustrated in FIGS. 10–12, like numerals are applied to like parts as in the first embodiment, with the numeral prefix "1" added thereto. Thus, the personal disposable emergency breathing system, generally designated 110, includes a canister 112, comprised of a canister body 113, a pair of intermediate securing rings 115 and 117 and a cover 118. Canister body 113 is open at its upper end and has an enlarged aperture 120 at its otherwise closed lower end. Aperture 120 is normally closed by a push-pull cylindrical closure 122 having a pull tab 123 whereby the closure 122 may be removed from aperture 120 when it is desired to actuate the breathing system. Closure 122 is preferably formed of a plastic material and lies flush with the bottom surface of canister 112. Pull tab 123 is formed to normally lie within a recess 127 (FIG. 12 and 14) formed along the side of the canister body at its lower end. In this manner, the tab 123 and closure 122 within the confines of the canister body to prevent inadvertent removal of closure 122. As best illustrated in FIG. 10, there is also provided a plurality of circumferentially spaced, upstanding ribs 125 formed on the bottom of canister 112 to elevate the filtration section 124 from the bottom of canister 112. By elevating the filtration section, the entire area below the filtration section 124 is exposed to air upon removal of closure 122. The use of the larger opening and the elevated filtration section precludes clogging of the filtration section due to build-up of soot particles and increases the efficiency of the filtering action. The enlarged opening 120 also reduces the risk of blocking the filtration section as a consequence of soot and carbon build-up. The upper end of canister 112 has a plurality of vertically spaced, interrupted, downwardly tapered portions 129 for securing the lower intermediate securing ring 115 to the top of canister body 112.

Lower intermediate ring 115 has complementary vertically spaced, interrupted, upwardly tapered portions 131 for joining with portions 129. Ring 115 also has vertically spaced, interrupted, radially outwardly directed, downwardly tapered portions 133 on the opposite side of an intermediate band 135 which lies flush with the external surface of canister body 112 and upper ring 117 and cover 118 in assembly. Radially inwardly of portion 133 and at the upper end of intermediate ring 115, there is provided a plurality of radially outwardly directed ribs 137.

Upper intermediate ring 117 includes a plurality of vertically spaced, interrupted, upwardly tapered portions 139 for complementarily engaging portions 133 of the lower intermediate ring 135 in assembly. The upper end of upper intermediate ring 117 includes interrupted, radially outwardly projecting flanges for releasable connection with complementary flanges formed on the inside of cover 118 upon rotation of cover 118 in either rotary direction.

As best illustrated in FIGS. 1 and 12, the filtration section 124 includes first, second and third stages 136, 138 and 140 formed of materials as previously described with respect to stages 36, 38 and 40 in the prior embodiment. These stages are likewise separated one from the other by electrostaticaly charged fiber filters 142, similar to filters 42 of the prior embodiment. As in the prior embodiment, metal grids may also be employed as separators.

In this embodiment, and also in the previous embodiment, an additional fourth and final stage 141 may comprise lithium peroxide or similar material for converting carbon dioxide to oxygen. The uppermost layer of the filtration section 124 may include a grid 143 of coated Teflon TM or copper wire retaining mesh and a similar grid may be provided at the bottom of the filtration section to afford structural rigidity thereto.

As in the previous embodiment, hood 134 has a full width opening 144 for passing the hood over the individual's head. The hood 134 envelops the mouthpiece 128 and plenum 126 which define the air passage 148 from the filtration section 124 to the user's mouth. In this embodiment, however, an insert 151, preferably formed of a hard plastic material, is provided to form a rigid, non-flexible seat for the intake and exhalation valves 130 and 132, respectively. The generally elliptical mouthpiece section 154 will stretch over the insert 151. The inhalation and exhalation valves 130 and 132 may be formed similarly as the corresponding valves of the prior embodiment and further description thereof is not believed necessary. In this embodiment, however, one of the exhaust valves 132 is provided with an enlarged annular flange 153 having an internal groove 155. A whistle 157 (FIG. 10) having a radially projecting rib 159 seats in the enlarged annular flange 153. The whistle is employed to locate the user of the breathing system hereof in the event the user is escaping in dense smoke or the like and cannot be readily located by rescuers. Preferably, the whistle is of a type which, during normal breathing, produces only a very low intensity whistle. However, the user may exhale rapidly and sharply to produce a high pitch whistle to assist rescuers or others in locating the user. The whistle 157 may well become an integral part of 141 by sonic welding.

The embodiment illustrated in FIGS. 10–12 facilitates manufacture and assembly of the breathing system. Particularly, the employment of an intermediate securing rings enables the independent assembly of the plenum section in conjunction with the two intermediate rings and cover and the filtration section in conjunction with the canister body 112. Those sections may then be assembled by bringing the lower portion of the lower intermediate ring 135 into securement with the upper end of the canister body 112, and particularly by engaging the tapered portions 131 and 129, respectively. It will be appreciated that a seal may be employed at that juncture to ensure air tightness, although the tapered portions are sufficient. Thus, it will be appreciated that, in this second embodiment, the filtration section may be initially disposed in the canister body 112. Independently, the plenum section with the intake and exhaust valves and hood may be assembled with the intermediate rings and the cover. More specifically, the annular collar 50 may be disposed about ribs 137 and the sealing ring applied. The upper intermediate ring 117 may then be applied about the sealing ring and collar 50 and secured to the lower intermediate ring 115 by the cooperation of the tapered portions 133 and 139. The manifold and hood may then be disposed within the intermediate rings and the cover 118 applied about the top of intermediate ring 117. Deployment of the breathing system of this second embodiment is similar to that described above in connection with the first embodiment and further description thereof is not believed necessary.

Referring now to FIGS. 13A and 13B, there are illustrated two additional preferred embodiments of the invention for effecting the connection between the parts of the canister body and wherein like references and wherein like reference numerals are applied to like parts followed by the letter suffixes "*a*" and "*b*", respectively. In FIG. 13A, the internal surface of intermediate ring **117*a* may be provided with a radially inwardly projecting annular projection, while the external surface of securing ring 115*a* may be provided with a complementary annular groove 162 extending circumferentially about ring 115*a*. This complementary projection and groove arrangement thus locates the parts during the course of manufacture and, after they are properly located, the parts may be ultrasonically welded to one another. The canister body 112*a* may likewise be secured to the lower intermediate securing ring 115*a* in a similar manner. For example, the internal surface of canister body 112*a* may be provided with an annular projection and the external surface of the intermediate ring 115*a* may be provided with a complementary groove. Thus, when these parts are located, the parts may be ultrasonically welded one to the other. Of course, the projections and grooves may be reversed with ring 115*a* carrying radially outward projections and the other parts 117*a* and 112*a*** carrying the grooves.

In FIG. 13B, there is illustrated another form of connection for the parts of the canister. In this form, the intermediate ring **117*b* and the upper end of canister body 112*b* may be smooth bore along their interior surfaces. Similarly, the intermediate ring 115*b*** may be smooth bore along its outer upper and lower connecting surfaces. By forming the smooth bores to tolerances for press-fits, a very tight fit may be provided during the manufacturing process. The parts may be subsequently ultrasonically welded one to the other.

Figure 15:
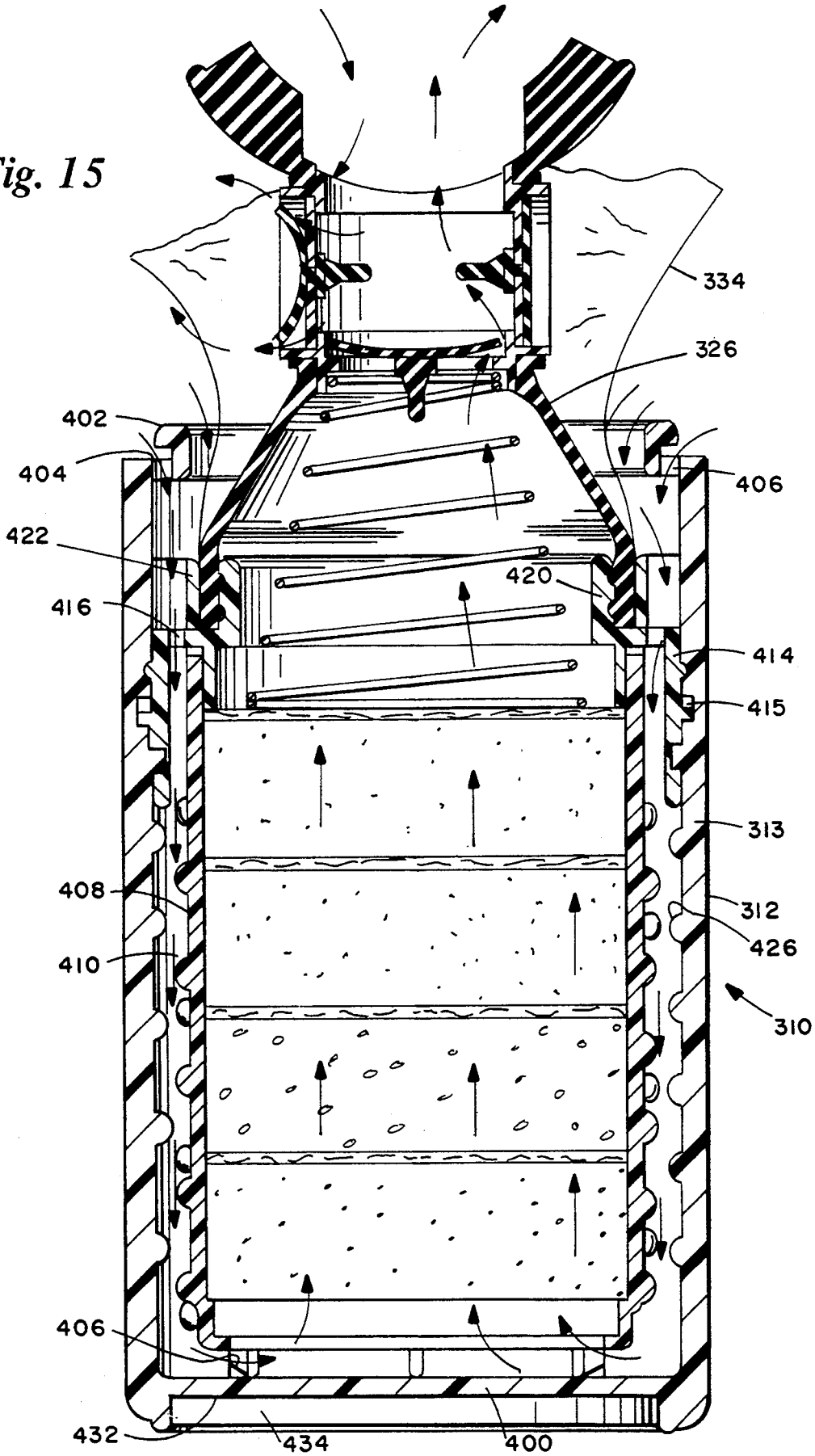
FIG. 15 is an enlarged vertical cross-sectional view of another embodiment of the breathing system hereof.

Referring now to the embodiment hereof illustrated in FIG. 15, like numerals are applied to like parts as in the prior embodiments with the numeral prefix 3 added thereto. Thus, the personal disposable emergency breathing system, generally designated 310, includes a canister 312 comprised of a canister body 313, closed at its lower end at 400. The upper end of canister body 313 has a number of equally spaced tabs or partial threads 402 mounted on a ring 404 having a plurality of apertures 406 therethrough serving as a secondary air inlet, as described below. The ring 402 receives the lid, complete with corresponding retaining tabs, not shown, in this drawing figure, but which lid seals the canister 310. Ribs 406 upstand from the bottom of the canister body 313.

In this form, the filtering material is contained in a filtration housing 408 which, when inserted into canister body 313, is spaced from the body 313 to define an annular channel or passage 410. The filtration housing 408 contains the identical filtering material previously described with respect to the other embodiments. A securing ring 414 overlies the upper end of filtration housing 408 and has external threads 416 for mating with threads on the internal wall surfaces of canister body 313. Ring 414 includes circumferentially spaced apertures 416 affording communication between the annular passage 410 and the volume within the upper end of canister body 313 whereby, when the lid is removed, air may flow into the canister body, through openings 416 and annular passage 410, past the ribs 406 and upwardly through the opening in the bottom of canister housing 408 for passage through the filter material. Ring 414 also carries an internal annular flange 420 which, in cooperation with a sealing ring 422, clamps the inner end of the plenum 326 to the filtration housing 408. Additionally, the marginal portions of the hood 334 are also clamped between the outer seal ring 422 and the plenum 326. The plenum carries the mouthpiece, check valves and other elements, similarly as previously described with respect to the prior embodiments. The arrows in the canister and air filtration unit as well as the upwardly directed arrows in the plenum as illustrated in FIG. 15 indicate the importance of air flow upon inhalation. The arrows on the left side of the plenum in FIG. 15 indicate the direction of exhalation air flow, i.e., through the check valve into the hood, the check valve at the base of the plenum being closed during exhalation.

An important feature of this embodiment resides in the formation of turbulence promoters on the inner and outer wall surfaces of the canister body 313 and filtration housing 408. These turbulence promoters may comprise a plurality of projections 426 formed on either one or both of these wall surfaces for purposes of creating turbulent flow of the polluted air as the polluted air passes through the annular channel 410. By creating the turbulent flow, large particles of polluted air, such as soot, tend to adhere to the wall surfaces and do not flow to the inlet of the filtration housing. This maintains the filtering material clear and unclogged for a longer period of time. The turbulence promoters may take any form, such as semi-spherical projections or ribs which extend circumferentially or at an angle. Alternatively, the side wall surfaces may be sandblasted to a textured surface.

Soot particulates are also trapped at the bottom of the canister by way of "impact." That is, the incoming air turns 180° to enter the filter canister. The larger soot particulates cannot negotiate this sudden 180° change of direction and therefore impact on the bottom of the inner surface of the outer container.

Additionally, there is provided a recess 432 on the bottom of the housing 310. A cylindrical chemical light 434 may be disposed in the recess. As is well known, such chemical lights are actuated by a force or pressure being applied to the light so that the membrane separating the chemicals may be broken whereby the chemicals may emit light to assist rescuers in locating the individual using the breathing system.

Figure 17:
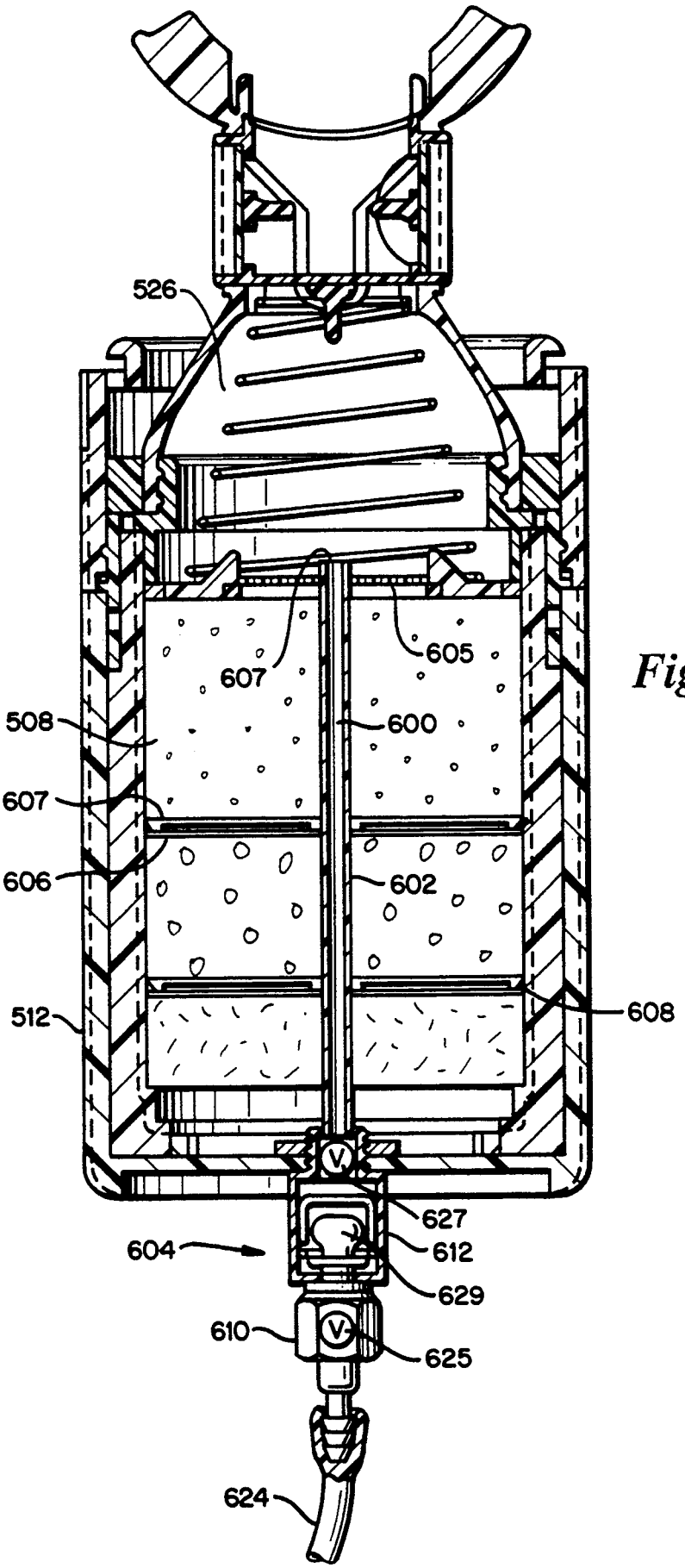
FIG. 17 is a cross-sectional view similar to FIG. 15 and illustrating the adaptation of the breathing system for simultaneous dual-flow of filtered ambient air and air from an external non-ambient air source.

Referring now to the embodiment hereof illustrated in FIGS. 16A, 16B and 17, wherein like numerals are applied to like parts as in the prior embodiments, with the numeral prefix 5 added thereto, it will be appreciated that one or more canisters 512 may be stored in a compartment 620, which may comprise an overhead compartment in an aircraft cabin. Compartment 620 has a door, not shown, which opens automatically or manually. When stored in overhead compartment 620, each canister is connected to a flexible conduit 622, in turn coupled to an external source of breathable air, for example, the oxygen supply system of the aircraft. Each canister is also coupled to the compartment 620 by a lanyard 624 secured to the lower and of the canister, preferably to a coupling part 612 of a coupling 604 described below. The opposite end of the lanyard is releasably coupled to a valve 611 which connects the flexible conduit 622 to the source of external air, i.e., the aircraft's oxygen supply. The canisters 512 of this embodiment are preferably similar to the canister illustrated in FIG. 15 wherein the canister 512 has a canister body 513 and a filtration unit 508 defining with the canister body the substantially annular air inlet channel for flowing ambient air from the open end of the canister through the channels and then for reverse flow through the filtration unit 508 to the plenum. It will be appreciated, however, that the canisters illustrated in FIGS. 16A and 16B may also be of the type first described, i.e., canisters having the ambient air inlet openings at the end of the canisters opposite the open end upon removal of the cover.

In this embodiment and referring to FIG. 17, an air flow conduit 600 extends, preferably axially, through the filtration unit 508. The conduit 600 may comprise a tubular plastic element 602 fixed to the lower end of the canister housing, centered within the filtration unit, and coupled to a quick connect/disconnect coupling, generally designated 604. The air flow conduit 600 extends centrally and axially through the layered filtration unit as previously described and through a screen 605 at the top of the filtration unit, terminating in an air flow outlet 607 whereby air flowing through the tube 602 enters plenum 526. The layers of the filtration unit are separated by pairs of a separating screen 606 and a stabilizing ring 607, both permitting air flow from one layer of filtration to the next with the screen 606 serving a filtering function. The stabilizing ring 607 provides an interference fit with the air flow conduit tube 602 and has beveled edges 608 providing for an interference fit with the side walls of the filtration unit 508. In this manner, air flow conduit tube 602 is essentially sealed for passage through filtration unit 508 whereby air flowing through the filtration unit does not channel or form cavities which might cause ambient air to flow unfiltered through the filtration unit.

As illustrated in FIG. 17, the quick connect/disconnect coupling may be of the type manufactured by Colder Products Company, St. Paul, Minn., identified as Mating Part Nos. PMCD10-02-12 and PMCD22-02-12. It will be appreciated that other types of quick connect/disconnect couplings may be employed. In this type of coupling, however, there is provided on each of the coupling parts a valve. Coupling part 610 is connected to the flexible conduit 624 and includes a normally open valve 625. Coupling part 612 carried by the canister includes a normally open valve 627. The coupling parts may be manually disconnected by pressing a button 629 on the side of the quick connect/disconnect coupling which also causes both valves 627 and 629 to close.

Upon an aircraft emergency, for example, cabin decompression or a fire, the compartment door lowers, enabling canisters 512 to deploy from the compartment and hang by the lanyard 624 in front of the seated individual. By grasping the canister and yanking the lanyard, the lanyard opens and releases from the normally closed valve 611 coupled to the aircraft oxygen supply whereby air is supplied to the canister plenum 526 through the flexible conduit 622, quick connect/disconnect coupling 604 and air flow conduit 600. It will be appreciated that the oxygen supplied through air flow conduit 600 bypasses the filtering material in the filtration unit 508. When the canister has been deployed, the individual removes the canister cover as previously described, enabling the hood and mouthpiece to be deployed. When the hood is donned by the individual and the mouthpiece inserted into the individual's mouth, it will be appreciated that the individual simultaneously breathes air supplied from the external source through air flow conduit 600 and filtered ambient air supplied through the open end of the canister, as previously described. It will also be appreciated that the canister may be in the form of any one of the previously described embodiments hereof, for example, the first-mentioned embodiment, wherein the ambient air flows into the canister through the filtration unit by way of one or more openings in the bottom of the canister. Consequently, the external source of air supplied the individual is supplemented by filtered ambient air, for example, filtered aircraft cabin air.

When the individual desires to evacuate the aircraft cabin, the latch button 629 on the quick connect/disconnect coupling 604 is depressed, disconnecting the part 610 from part 612. The valves in those parts automatically close in response to the disconnection. As a consequence, flow of air from the external source is discontinued and air flow conduit 600 is closed to ambient air by the valve in part 612. Thus, the individual breathes only filtered ambient air. Also, it will be appreciated that the emergency breathing system has now been totally detached from the aircraft emergency oxygen supply system, enabling the individual to exit the aircraft while carrying the canister and wearing the hood and continuing to breathe.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A personal emergency breathing system for filtering ambient air and flowing breathable air from an external source other than ambient air comprising:

a canister having a body with an opening and a cover normally closing said opening;

an air filtration unit disposed within the body of said canister for filtering ambient air and having an air inlet for receiving ambient air and an air outlet, the ambient air being receivable through said air inlet into said filtration unit where it is filtered and passed through said air outlet;

a mouthpiece carried by said canister for receiving filtered air from the outlet of said filtration unit;

a hood carried by said canister and enveloping said mouthpiece, said mouthpiece and said hood being disposed in a collapsed condition in said canister adjacent said opening and between said cover and said filtration unit whereby, upon opening of said cover, said hood and said mouthpiece are deployable from said canister through said opening to a location external to said canister, said hood having an opening for receiving an individual's head and neck whereby the hood, when deployed, may envelop an individual's head;

means for connecting said hood and said mouthpiece to said canister in said collapsed condition and when deployed;

means establishing an air flow path from said air outlet to said mouthpiece when said hood and said mouthpiece are deployed enabling flow of filtered air from said filtration unit air outlet to said mouthpiece and preventing flow of filtered air from said filtration unit air outlet into said hood; and an air flow conduit carried by said canister body bypassing said filtration unit and having an air flow inlet for connection with an external source of breathable air other than ambient air and an air flow outlet, said air flow outlet lying in communication with said mouthpiece whereby said air flow conduit enables flow of air from the external source of breathable air into said mouthpiece when said hood and said mouthpiece are deployed and without the air from the external source passing through said filtration unit.

2. A system according to claim 1 including a valve in said air flow conduit for respectively enabling and preventing flow of air from the external source through said air flow conduit.

3. A system according to claim 2 wherein said canister body is elongated and has said opening at one end thereof, said filtration unit being centrally disposed in said canister body, said air flow conduit comprising a passage extending through said filtration unit, said air flow inlet being carried by said canister body adjacent an end of said body opposite said one end for connection to the external source of breathable air.

4. A system according to claim 3 wherein said valve is normally open.

5. A system according to claim 4 wherein said air flow conduit is substantially sealed within said filtration unit whereby ambient air passing through said filtration unit is substantially prevented from channeling in said filtration unit.

6. A system according to claim 1 wherein said mouthpiece lies in communication with both said filtration unit air outlet and said air flow outlet when said hood and mouthpiece are deployed to simultaneously provide breathable filtered ambient air and air from the external source to said mouthpiece.

7. A system according to claim 6 including a valve in said air flow conduit for respectively enabling and preventing flow of air from the external source through said air flow conduit, said air flow inlet including a quick disconnect coupling for connection with the external source of breathable air whereby the canister may be disconnected from the external air source, said valve being closable when the canister is disconnected from the external source of breathable air to preclude flow of ambient air through said air flow conduit such that only ambient air filtered through said filtration unit is provided the mouthpiece.

8. A system according to claim 1 including first and second one-way valves disposed between said mouthpiece and said filtration unit, said first valve enabling flow of filtered ambient air from said filtration unit air outlet into said mouthpiece and preventing backflow of exhaled air into said filtration unit, said second valve enabling air exhaled into said mouthpiece for flow into said hood and preventing backflow of air from said hood through said second valve to said mouthpiece.

9. A system according to claim 8 including means for substantially closing said hood opening about the individual's neck whereby the hood completely envelopes the individual's head, and the air exhaled by the individual through said second valve into said hood affords a positive pressure in said hood relative to ambient pressure, thus preventing ingress of non-filtered air into the hood through said hood opening.

10. A system according to claim 9 including means for substantially closing said hood opening about the individual's neck whereby the hood completely envelopes the individual's head, and the air exhaled by the individual through said second valve into said hood affords a positive pressure in said hood relative to ambient pressure, thus preventing ingress of non-filtered air into the hood through said hood opening.

11. A personal emergency breathing system according to claim 1 wherein said canister body includes an ambient air passage within said body in communication with said body openings, said air filtration unit including a housing spaced from said canister body, the space between said canister body and said housing constituting at least in part said ambient air passage between said canister body opening and said air inlet to said air filtration unit.

12. A personal emergency breathing system according to claim 1 wherein said canister body includes an ambient air passage within said body in communication with said body opening, said air filtration unit including a housing spaced from said canister body, the space between said canister body and said housing constituting at least in part said ambient air passage between said canister body opening and said air inlet to said air filtration unit, said air inlet being disposed at one end of said air filtration unit and adjacent an end of the canister remote from said open end thereof whereby ambient air entering the canister body opening and flowing through said space reverses direction for entry into said air inlet thereby trapping large particles within the canister as the air flow direction reverses.

13. A personal emergency breathing system comprising:

a compartment;

a canister disposed in said compartment and deployable therefrom, a flexible external air supply conduit disposed in said compartment with said canister for connection to a source of breathable air other than ambient air, said flexible conduit being connected to said canister, and at least in part, being deployable from said compartment with said canister, and a normally closed valve for precluding air flow from the external source to said canister;

said canister having a body with an opening and a cover normally closing said opening;

an air filtration unit disposed within the body of said canister for filtering ambient air and having an air inlet for receiving ambient air and an air outlet, the ambient air being receivable through said air inlet into said filtration unit for filtering and passage through said air outlet;

a mouthpiece carried by said canister for receiving filtered air from the outlet of said filtration unit;

a hood carried by said canister and enveloping said mouthpiece, said mouthpiece and said hood being disposed in a collapsed condition in said canister adjacent said opening and between said cover and said filtration unit whereby, upon deployment of said canister from said compartment and opening said cover, said hood and mouthpiece are deployable from said canister to a location external to said canister, said hood having an opening for receiving a individual's head and neck whereby the hood, when deployed, may envelop an individual's head;

means for connecting said hood and said mouthpiece to said canister in said collapsed condition and when deployed therefrom;

an air flow conduit carried by said canister body bypassing said filtration unit and having an air flow inlet and an air flow outlet, a releasable coupling connecting said air flow inlet and said flexible external air supply conduit, said air flow outlet lying in communication with said mouthpiece whereby said flexible external air supply conduit and said air flow conduit enable flow of air from said external source of air into said mouthpiece when said canister is deployed from said compartment and said hood and said mouthpiece are deployed from said canister and without the air from the external source passing through said filtration unit; and means for opening said normally closed valve when said canister is deployed from said compartment to flow air from said external source into said mouthpiece.

14. A system according to claim 13 wherein said valve opening means includes a lanyard connected to said valve and said canister whereby pulling said lanyard opens said valve.

15. A system according to claim 13 wherein said mouthpiece lies in communication with said filtration unit air outlet and said air flow conduit outlet when said canister is deployed from said compartment, said hood and said mouthpiece are deployed from said canister and said valve is opened to simultaneously provide breathable ambient air and air from the external source of breathable air to said mouthpiece.

16. A system according to claim 15 including a valve in said air flow conduit for respectively enabling and preventing flow of air from the external source of breathable air through said air flow conduit, said air inlet including a quick connect coupling for connection with said flexible conduit whereby the canister may be disconnected from the external air source, said valve in said air flow conduit being closable when the canister is disconnected from the external source of breathable air such that only filtered ambient air is provided the mouthpiece.

17. A system according to claim 13 including first and second one-way valves disposed between said mouthpiece and said filtration unit, said first valve enabling flow of filtered ambient air from said filtration unit air outlet into said mouthpiece and preventing backflow of exhaled air into said filtration unit, said second valve enabling air exhaled into said mouthpiece for flow into said hood and preventing backflow of air from said hood through said second valve to said mouthpiece.

18. A personal emergency breathing system according to claim 13 wherein said canister body includes an ambient air passage within said body in communication with said body openings, said air filtration unit including a housing spaced from said canister body, the space between said canister body and said housing constituting at least in part said ambient air passage between said canister body opening and said air inlet to said air filtration unit.

19. A personal emergency breathing system according to claim 13 wherein said canister body includes an ambient air passage within said body in communication with said body opening, said air filtration unit including a housing spaced from said canister body, the space between said canister body and said housing constituting at least in part said ambient air passage between said canister body opening and said air inlet to said air filtration unit, said air inlet being disposed at one end of said air filtration unit and adjacent an end of the canister remote from said open end thereof whereby ambient air entering the canister body opening and flowing through said space reverses direction for entry into said air inlet thereby trapping large particles within the canister as the air flow direction reverses.

* * * * *